US011186352B1

(12) United States Patent
Erickson et al.

(10) Patent No.: US 11,186,352 B1
(45) Date of Patent: Nov. 30, 2021

(54) SYSTEMS AND METHODS FOR INCORPORATING TILT LOCKING INTO TILLERS

(71) Applicant: Brunswick Corporation, Mettawa, IL (US)

(72) Inventors: James E. Erickson, Fond du Lac, WI (US); Jolayne K. Ingebritson, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 63 days.

(21) Appl. No.: 16/727,602

(22) Filed: Dec. 26, 2019

(51) Int. Cl.
*B63H 25/10* (2006.01)
*B63H 20/12* (2006.01)
*B63H 21/21* (2006.01)

(52) U.S. Cl.
CPC ..... *B63H 25/10* (2013.01); *B63H 20/12* (2013.01); *B63H 21/213* (2013.01)

(58) Field of Classification Search
CPC ..... B63H 20/00; B63H 20/08; B63H 20/10; B63H 20/12; B63H 21/00; B63H 21/21; B63H 21/213; B63H 21/26; B63H 21/265; B63H 25/00; B63H 25/10
USPC ..... 114/172; 440/63
See application file for complete search history.

(56) References Cited

U.S. PATENT DOCUMENTS 3,636,911 A 1/1972 Piazza et al.
3,922,996 A 12/1975 Meyer
D276,811 S 12/1984 Wolfe
4,496,326 A 1/1985 Boda
4,521,201 A 6/1985 Wantanabe
4,582,493 A 4/1986 Toyohara
4,650,429 A 3/1987 Boda
4,701,141 A 10/1987 Sumigawa
D295,867 S 5/1988 Walsh
4,878,468 A 11/1989 Boda et al.
5,145,427 A 9/1992 Kawai
5,340,342 A 8/1994 Boda et al.
(Continued)

FOREIGN PATENT DOCUMENTS

JP 3946315 B2 7/2007
JP 4094151 B2 6/2008
(Continued)

OTHER PUBLICATIONS

Honda Marine Set-Up Instructions, Long Tiller Handle, BF060A-BFP60A, Honda Motor Co., Ltd. printed May 2009, #87997-ZZ3-A00.

*Primary Examiner* — Lars A Olson
(74) *Attorney, Agent, or Firm* — Andrus Intellectual Property Law, LLP

(57) ABSTRACT

A tiller system for steering a marine propulsion device. The tiller system includes a tiller arm rotatably coupled to the marine propulsion device. The tiller arm is rotatable from a down position to an up position through a plurality of lock positions therebetween. A toothed member is coupled to one of the tiller arm and the marine propulsion device. The toothed member defines a plurality of teeth corresponding to the plurality of lock positions for the tiller arm. A pawl is coupled to another of the tiller arm and the marine propulsion device, where the pawl engages with the plurality of teeth to prevent the tiller arm from rotating downwardly through the plurality of lock positions.

19 Claims, 16 Drawing Sheets

(56) References Cited

U.S. PATENT DOCUMENTS

| | | | |
|---|---|---|---|
| 5,545,064 | A | 8/1996 | Tsunekawa et al. |
| 5,632,657 | A | 5/1997 | Henderson |
| D380,478 | S | 7/1997 | Robbins |
| 5,797,777 | A | 8/1998 | Tsunekawa et al. |
| 6,010,563 | A | 2/2000 | Risk, Jr. |
| 6,020,563 | A | 2/2000 | Risk et al. |
| 6,093,066 | A | 7/2000 | Isogawa et al. |
| 6,146,221 | A | 11/2000 | Natsume |
| 6,264,516 | B1 | 7/2001 | McEathron et al. |
| 6,336,835 | B1 | 1/2002 | Naganuma |
| 6,352,456 | B1 | 3/2002 | Jaszewski et al. |
| 6,352,457 | B1 | 3/2002 | Higby et al. |
| 6,406,342 | B1 | 6/2002 | Walczak et al. |
| 6,406,343 | B2 | 6/2002 | Kawai et al. |
| 6,648,703 | B2 | 11/2003 | McChesney et al. |
| 6,902,450 | B2 | 6/2005 | Ohtsuki et al. |
| 7,090,551 | B1 | 8/2006 | Lokken et al. |
| D527,737 | S | 9/2006 | Iekura |
| 7,160,160 | B2 | 1/2007 | Kojima |
| 7,214,113 | B2 | 5/2007 | Kojima |
| D552,129 | S | 10/2007 | Steinberg |
| 7,404,747 | B2 | 7/2008 | Shinde et al. |
| 7,442,104 | B2 | 10/2008 | Okabe |
| 7,455,558 | B2 | 11/2008 | Yander |
| 7,553,206 | B2 | 6/2009 | Hasegawa et al. |
| 7,666,038 | B2 | 2/2010 | Yomo et al. |
| D611,501 | S | 3/2010 | Vignau et al. |
| D611,502 | S | 3/2010 | Vignau et al. |
| 7,677,938 | B2 | 3/2010 | Wiatrowski et al. |
| 7,704,110 | B2 | 4/2010 | Wiatrowski et al. |
| 7,895,959 | B1 | 3/2011 | Angel et al. |
| 7,976,354 | B2 | 7/2011 | Kubota et al. |
| D655,308 | S | 3/2012 | Steinberg |
| 8,257,122 | B1 | 9/2012 | Holley |
| 9,004,964 | B2 | 4/2015 | Grez |
| 9,422,045 | B2 | 8/2016 | Kinpara et al. |
| 9,764,813 | B1 | 9/2017 | Zarembka et al. |
| 9,776,698 | B2 | 10/2017 | Miyatake et al. |
| 9,783,278 | B1 | 10/2017 | Dannenberg et al. |
| 9,789,945 | B1 | 10/2017 | Vaninetti et al. |
| 9,896,176 | B2 | 2/2018 | Suzuki et al. |
| 10,787,236 | B1 * | 9/2020 | Erickson ..... B63H 20/12 |
| 2001/0046819 | A1 | 11/2001 | Kawai et al. |
| 2004/0137806 | A1 | 7/2004 | Ohtsuki |

FOREIGN PATENT DOCUMENTS

| | | | |
|---|---|---|---|
| JP | 5927980 | B2 | 9/2013 |
| JP | 2013173423 | A | 9/2013 |
| JP | 5741259 | B2 | 7/2015 |

* cited by examiner

SYSTEMS AND METHODS FOR INCORPORATING TILT LOCKING INTO TILLERS

FIELD

The present disclosure generally relates to tillers for steering marine vessels, and more particularly to systems and methods for incorporating tilt locking functionality into tiller arms for steering marine vessels.

BACKGROUND

The Background and Summary are provided to introduce a foundation and selection of concepts that are further described below in the Detailed Description. The Background and Summary are not intended to identify key or essential features of the potentially claimed subject matter, nor are they intended to be used as an aid in limiting the scope of the potentially claimed subject matter.

The following U.S. Patents are incorporated herein by reference:

U.S. Pat. No. 4,496,326 discloses a steering system for a marine drive having a propulsion unit pivotally mounted on the transom of a watercraft and a tiller. The steering system includes a steering vane rotatably mounted on the propulsion unit for generating hydrodynamic forces to pivot or assist in pivoting the propulsion unit and to counteract propeller torque. A mount interposed between the propulsion unit and the tiller mounts the tiller for movement relative to the propulsion unit. A cable connects the tiller to the steering vane so that movement of the tiller with respect to the propulsion unit rotates the vane. The mount includes mutually engageable elements that can lock the tiller against movement relative to the propulsion unit so that the tiller may be used to directly steer the propulsion unit, if desired. For this purpose, the elements of the mount may be engaged by applying a downward pressure on the tiller.

U.S. Pat. No. 5,340,342 discloses a tiller handle for use with one or more push-pull cables innerconnected to the shift and the throttle mechanisms of an outboard marine engine to control the shift and the throttle operations of the engine. The tiller handle includes a rotatable cam member with one or more cam tracks located on its outer surface. Each push-pull cable is maintained within a distinct cam track such that rotating the rotatable cam member actuates the push-pull cables thereby controlling the operation of the shift and the throttle mechanisms of the engine.

U.S. Pat. No. 5,632,657 discloses a movable handle mounted to a trolling motorhead. The handle is pivotally adjustable upwardly and downwardly to suit different positions of a fisherman while controlling the trolling motor. The handle spans across the motorhead and acts as a tiller for pivoting the motor about its axis. The resistance to positional changes is adjustable and protective features are provided to prevent damage to the adjustment mechanism in the event of tightening. The handle incorporates therein various controls for the motorhead.

U.S. Pat. No. 6,264,516 discloses an outboard motor provided with a tiller handle that enables an operator to control the transmission gear selection and the throttle setting by rotating the hand grip of the tiller handle. It also comprises a means for allowing the operator to disengage the gear selecting mechanism from the throttle mechanism. This allows the operator to manipulate the throttle setting without having to change the gear setting from neutral position.

U.S. Pat. No. 7,090,551 discloses a tiller arm with a lock mechanism that retains the tiller arm in an upwardly extending position relative to an outboard motor when the tiller arm is rotated about a first axis and the lock mechanism is placed in a first of two positions. Contact between an extension portion of the lock mechanism and the discontinuity of the arm prevents the arm from rotating downwardly out of its upward position.

U.S. Pat. No. 9,422,045 discloses an operating device of an electric outboard motor having a steering bar-shaped handle projecting forward and pivotally supported on a hull to be able to steer right and left. A propeller of the electric outboard motor is driven by an electric motor driven by power supplied from a power supply. On a tip portion of the steering bar-shaped handle, the operating device is provided with an accelerator grip that is made to pivot on an axial center normally and reversely from a neutral position to adjust an amount of power to be supplied to the electric motor according to a pivot amount. The operating device includes in the accelerator grip or in vicinity of the accelerator grip, an accelerator grip fixing mechanism that fixes a pivot position of the accelerator grip at the neutral position to be able to release a fixation easily.

Additional information relating to tiller systems for steering marine propulsion device is also provided in U.S. Pat. Nos. 6,093,066, 6,406,342, 6,902,450, 7,214,113, 7,455,558, 7,677,938, and 7,704,110.

SUMMARY

One embodiment of the present disclosure generally relates to a tiller system for steering a marine propulsion device. The tiller system includes a tiller arm rotatably coupled to the marine propulsion device. The tiller arm is rotatable from a down position to an up position through a plurality of lock positions therebetween. A toothed member is coupled to one of the tiller arm and the marine propulsion device. The toothed member defines a plurality of teeth corresponding to the plurality of lock positions for the tiller arm. A pawl is coupled to another of the tiller arm and the marine propulsion device, where the pawl engages with the plurality of teeth to prevent the tiller arm from rotating downwardly through the plurality of lock positions.

Another embodiment of the present disclosure generally relates to a tiller system for steering a marine propulsion device. The tiller system includes a tiller arm rotatably coupled to the marine propulsion device. The tiller arm is rotatable from a down position to an up position and into at least five lock positions therebetween. A toothed member is coupled to the tiller arm and defines at least five teeth corresponding to the at least five lock positions for the tiller arm. A pawl is coupled to the marine propulsion device, where the pawl engages with the at least five teeth to prevent the tiller arm from rotating downwardly through the at least five lock positions. The tiller arm is made of a first material having a first strength, and the toothed member is made of a second material having a second strength that is greater than the first strength.

Various other features, objects and advantages of the disclosure will be made apparent from the following description taken together with the drawings.

BRIEF DESCRIPTION OF THE DRAWINGS

The drawings illustrate examples of carrying out the disclosure. The same numbers are used throughout the drawings to reference like features and like components. In the drawings.

DETAILED DISCLOSURE

Tiller systems are known devices for steering marine vessels. Within the context of tiller-based steering, it is often desirable for the operator to be able to tilt the tiller, and specifically the tiller arm, with respect to the rudder or marine propulsion device being steered, depending on the use and conditions of operation. Some tiller systems known in the art allow the operator to lock the tiller arm in certain positions, such as in a full-up or trailer position, and sometimes a mid-point position somewhere between the up and down positions. One such tiller system includes a ratcheting tilt lock device, such as used in the Mercury 15/20EFI outboard motor. A used herein, a marine propulsion device includes, but is not limited to, outboard motors. It will be recognized that other embodiments incorporate cross-pin locks that engage with the chassis.

Through experimentation and development, the present inventors have identified issues with releasing the tiller from a locked position using systems presently known in the art. Specifically, unlocking the tiller requires the operator to reach back towards the marine propulsion device to manipulate a tilt lock knob or lever. This is inconvenient, particularly with marine vessels having the operator positioned farther forward or where the tiller is relatively long.

The present inventors have further identified that the Mercury 15/20EFI system has no mechanism for permanently deactivating a tilt lock system. Therefore, when a tiller arm is raised, it will automatically lock as it reaches a locking position. Additional detail regarding these locking positions, along with corresponding indexes, is provided below. The present inventors have also identified that it is for this reason that most tiller systems are lockable only at the full tilt or trailer position, or in some cases at a single additional mid-position lock.

Figure 1:
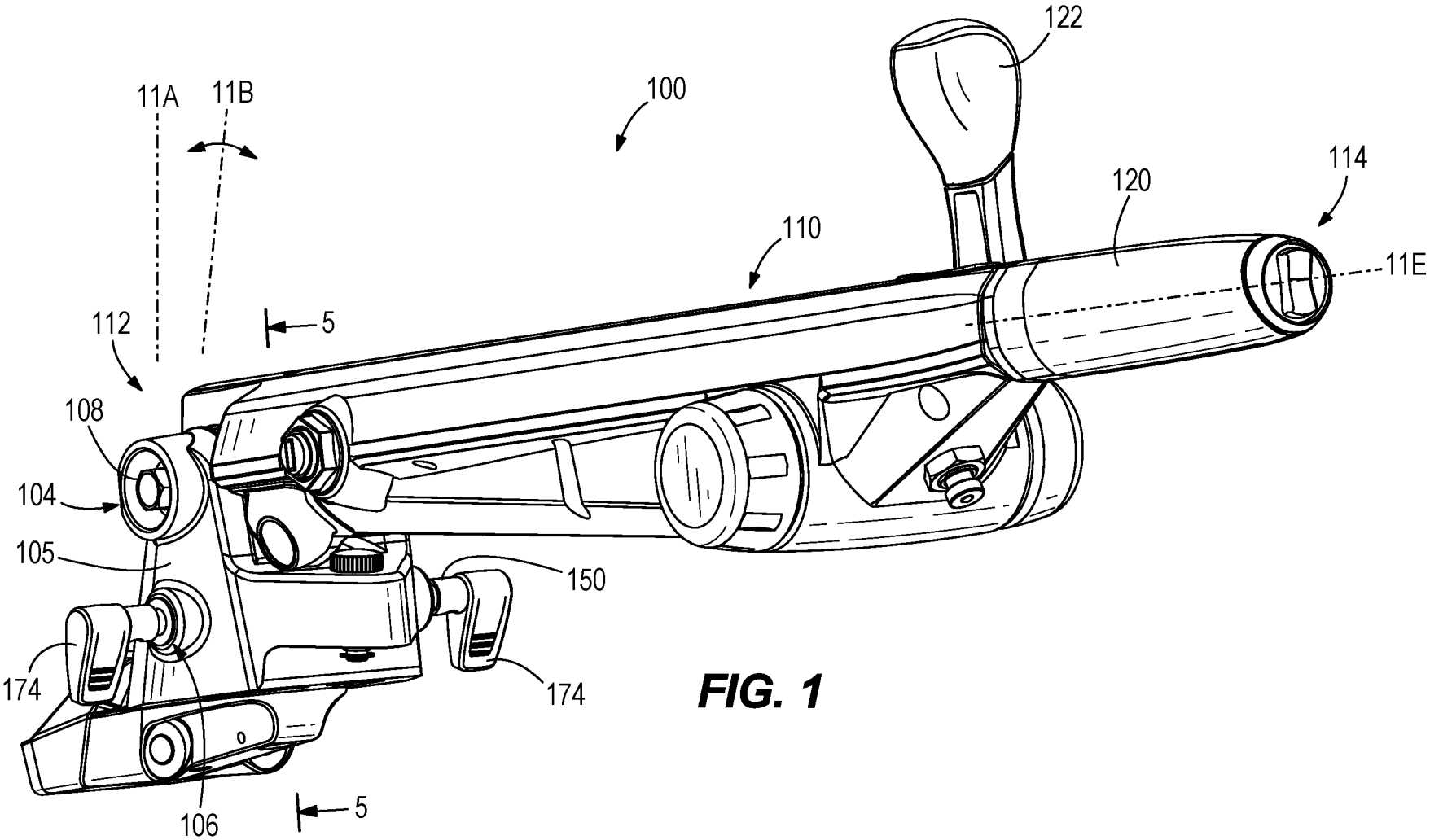
FIG. 1 depicts a perspective view of a tiller tilt and automatic release system according to the present disclosure.

FIG. 1 depicts an exemplary embodiment of a tiller system 100 according to the present disclosure. The tiller system 100 includes a tiller arm 110 that has a pivot end 112 and an opposite handle end 114. A handle 120 is positioned at the handle end 114 of the tiller arm 110, which is grasped by the operator during operation of the marine vessel. A mounting structure 105 is connected to a steering arm of a propulsion device or rudder (not shown) in the customary manner known in the art. The tiller arm 110 is pivotably connected at the pivot end 112 to the mounting structure 105 by a tilt axle 108. Specifically, the tilt axle 108 extends through a tilt axle opening 115 (FIG. 2) within the tiller arm 110 and is received in a tilt axle opening 104 within the mounting structure 105. In this manner, the tiller arm 110 pivots about a tilt axis TA (FIG. 2) formed by the tilt axle 108 between an up position 11A and a down position 11E shown in FIG. 3. Intermediate positions are also defined between the up position 11A and the down position 11E, such as intermediate position 11B as shown. It should be recognized that the up position 11A need not be completely vertical (either closer or farther from the down position 11E), and likewise the down position 11E need not be completely horizontal (i.e., 5 degrees above horizontal).

FIG. 1 further show portions of a tilt lock system 130 (see also FIGS. 2-4) to be discussed below for locking the tiller arm 110 between the up position 11A and the down position 11E. In particular, FIG. 1 shows a tilt lock shaft 150 that is rotatable via a tilt lock knob 174 to activate and deactivate the tilt lock system 130. The tilt lock shaft 150 extends through a tilt lock shaft opening 106 in the mounting structure 105, which is discussed further below.

Figure 2:
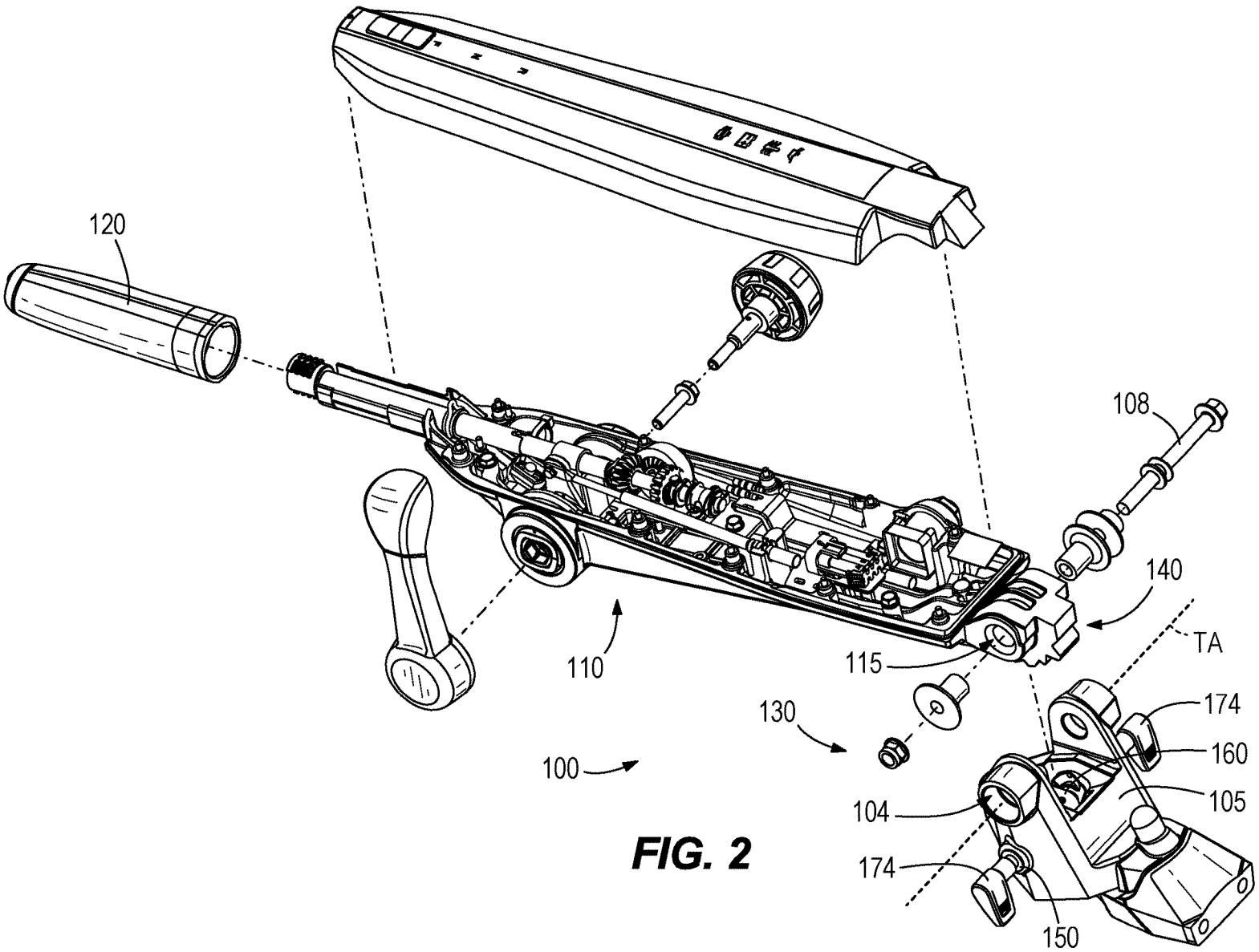
FIG. 2 is an exploded perspective view of the opposite side of the system from FIG. 1.
Figure 3:
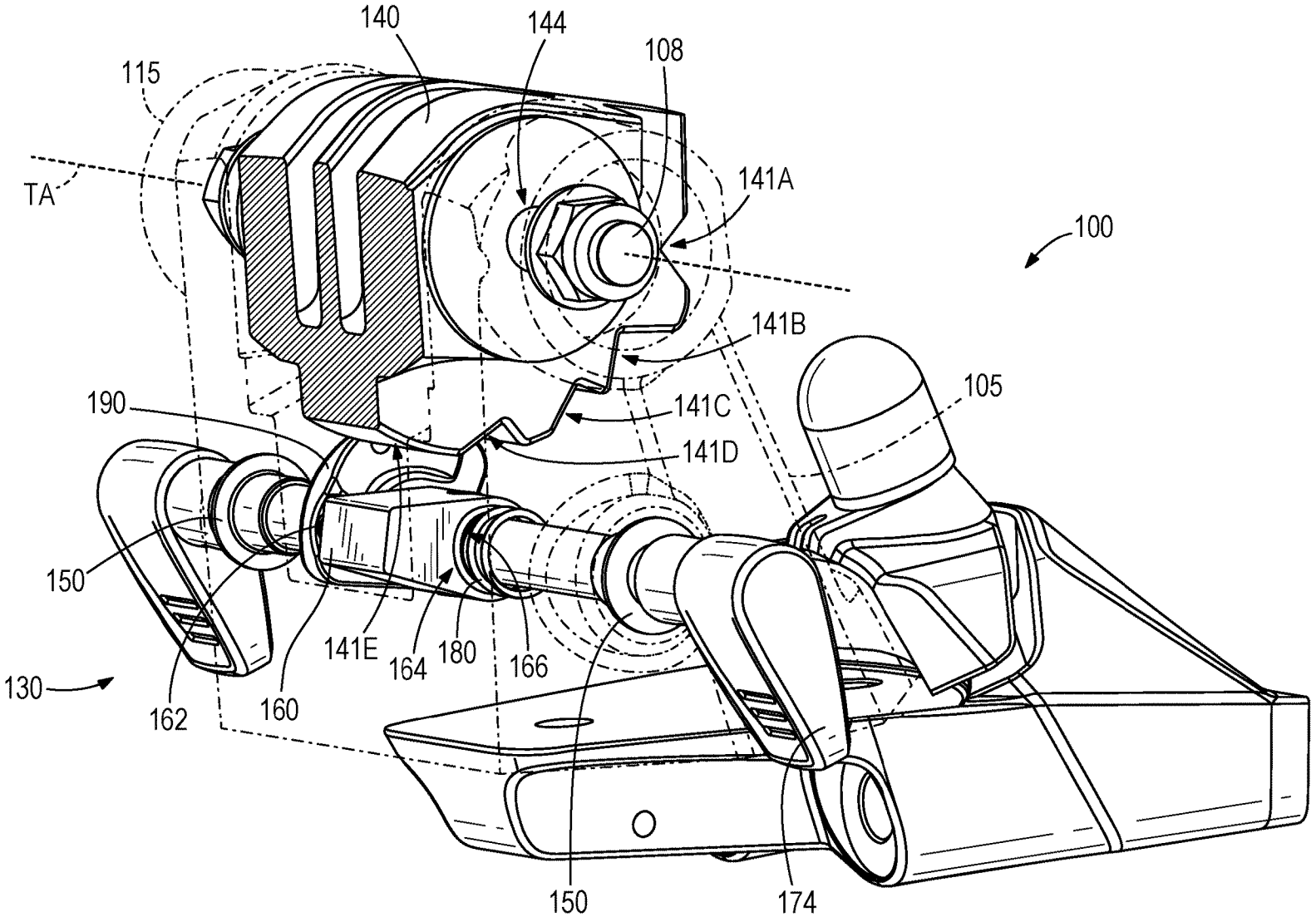
FIG. 3 is a close up front view of the system shown in FIG. 2 shown with the tiller arm removed.
Figure 4:
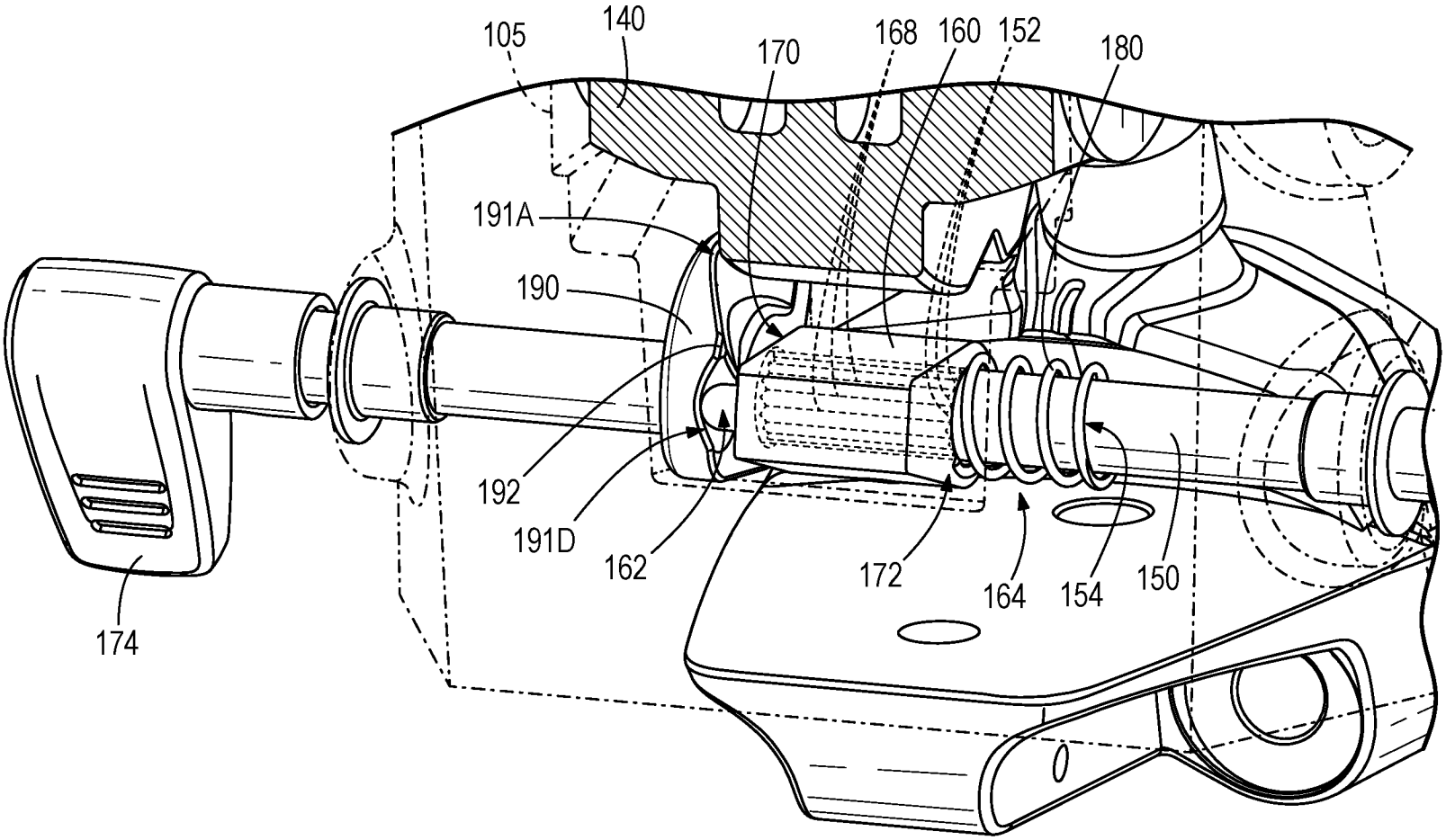
FIG. 4 is a close up front view of an alternate embodiment similar to that shown in FIG. 3.

FIG. 2 is an exploded view of the tiller system 100 of FIG. 1, which also shows a tilt lock system 130 according to the present disclosure. The tilt lock system 130 includes a first lock portion 140 that is coupled to the tiller arm 110 and a second lock portion 160 that remains with the mounting structure 105. FIGS. 3-4 show close-up views of the tilt lock system 130 of FIG. 2, presently depicting the first lock portion 140 and the second lock portion 160 in a deactivated or non-engaged state. The first lock portion 140 is fixed relative to the tiller arm 110. The same tilt axle 108 that pivotably couples the tiller arm 110 to the mounting structure 105 also extends through a tilt axle opening 144 within the first lock portion 140. In this manner, the first lock portion 140 pivots with the tiller arm 110 about the tilt axis TA. However, it should be recognized that the present disclosure also anticipates embodiments in which the first lock portion 140 remains with the mounting structure 105 and the second lock portion 160 pivots with the tiller arm 110.

Figure 9:
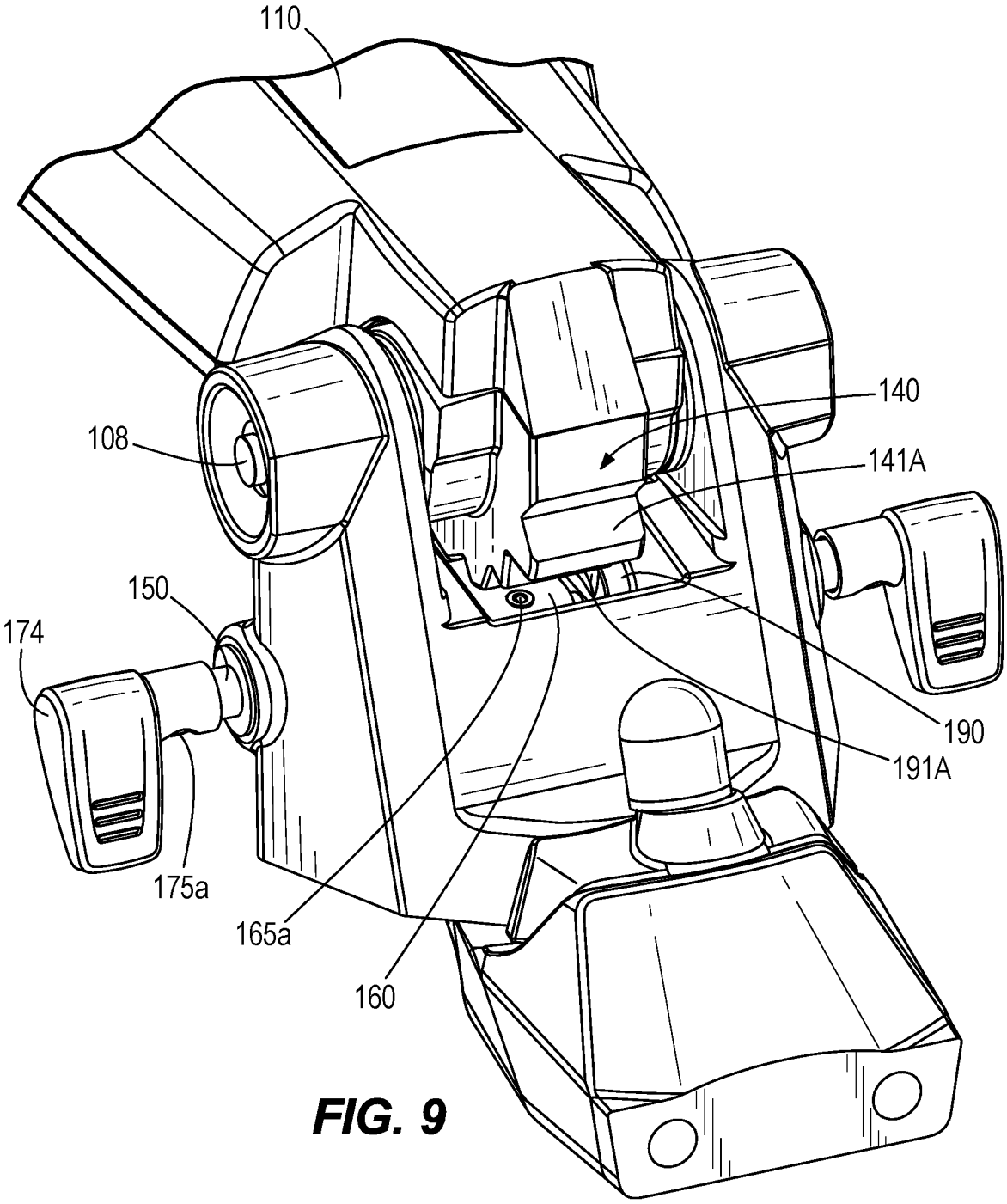
FIG. 9 is a close up rear perspective view of the system shown in FIG. 2.

As shown in FIGS. 3-4, the second lock portion 160 has an opening 166 (also shown in FIG. 11) for receiving the tilt lock shaft 150. The tilt lock shaft 150 is rotatable through operation of either one of the tilt lock knobs 174, which are coupled to opposite sides of the tilt lock shaft 150 to provide for ambidextrous use of the tiller system 100 in operation. In the embodiment shown in FIG. 4, the second lock portion 160 is coupled to the tilt lock shaft 150 via a spline joint formed by teeth 168 within the second lock portion 160 being received within grooves 152 defined within the tilt lock shaft 150. However, other mechanisms for coupling the second lock portion 160 and the tilt lock shaft 150 are also known in the art, such as through integral formation, subsequent coupling using set pins 175*a* received within openings 165*a* in the second lock portion 160 and tilt lock shaft 150 (see FIGS. 9-11), or welding, for example.

FIGS. 3-4 show the second lock portion 160 being rotatable via the tilt lock shaft 150 into and out of engagement with the first lock portion 140. More specifically, the second lock portion 160 is engageable with a number of indexes within the first lock portion 140, which correspond to the different positions for locking the tiller arm 110 discussed above. Additional views of the tilt lock system 130 are also provided in FIGS. 9-11 and discussed further below.

Figure 5:
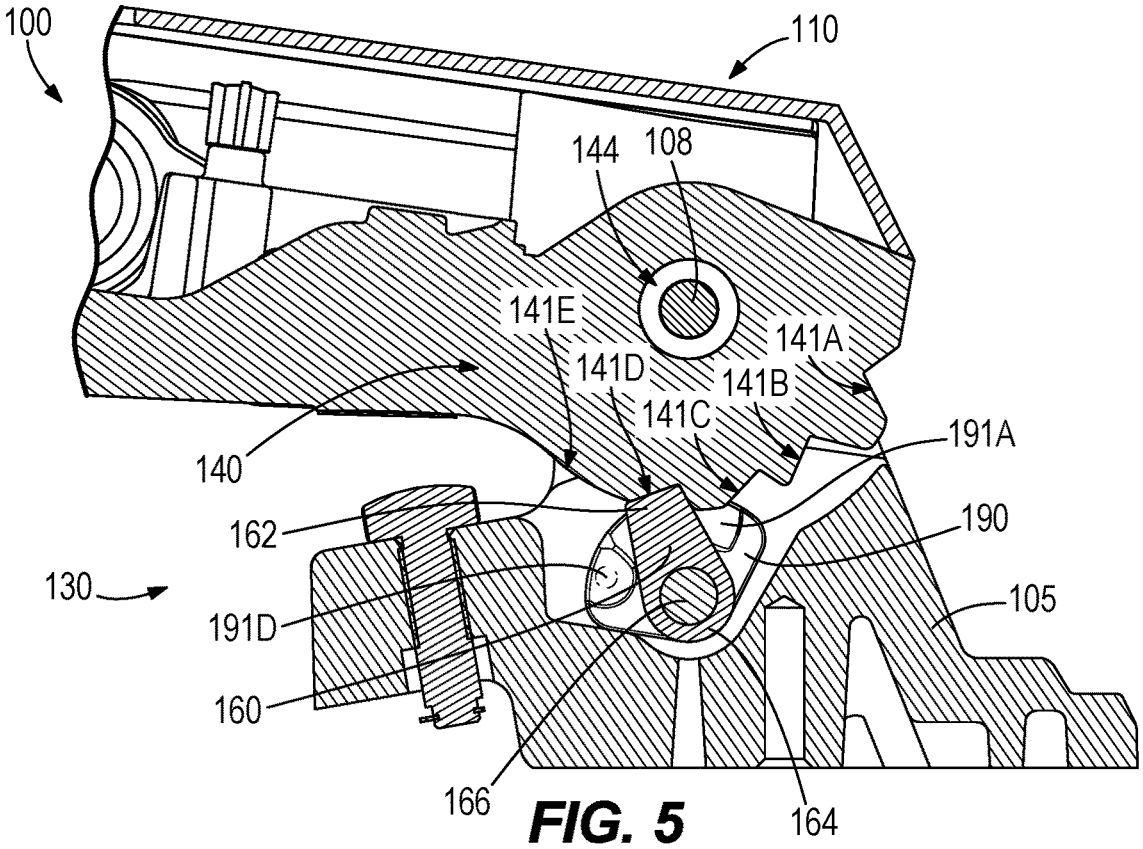
FIGS. 5-7 are sectional side views taken along the line 5-5 taken in FIG. 1 depicting progressive upward rotation and locking of the tiller arm.
Figure 6:
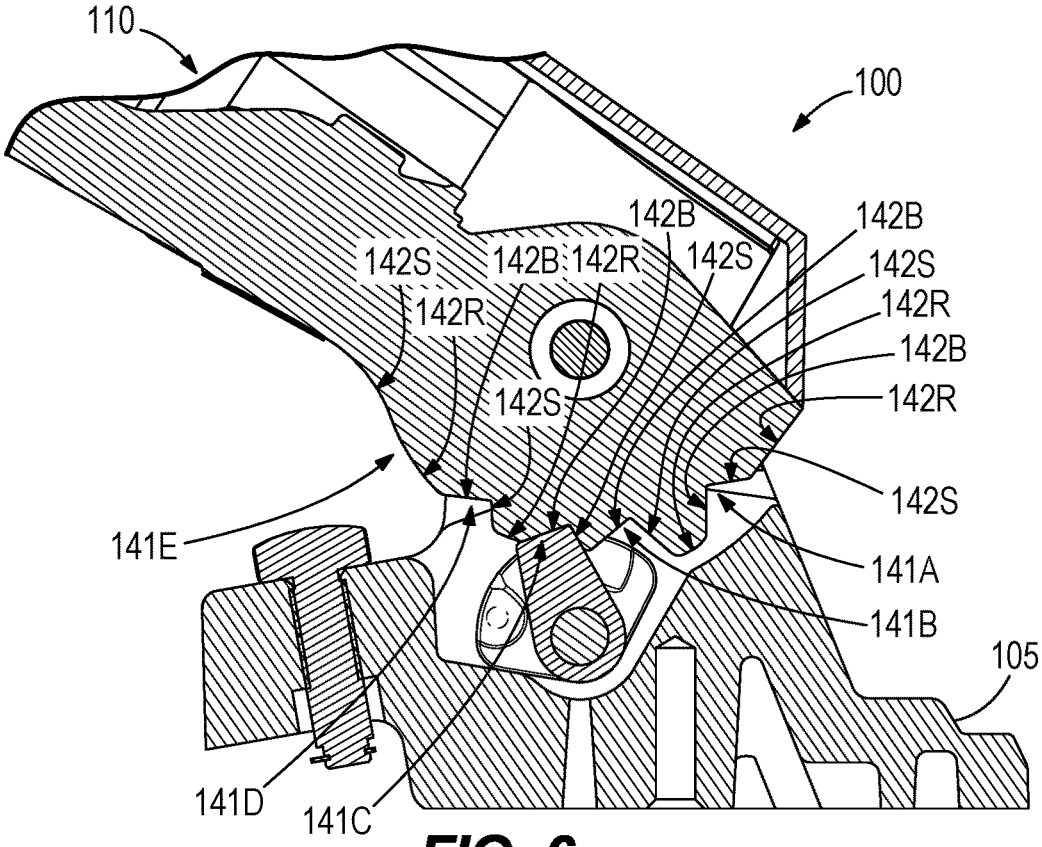
Figure 7:
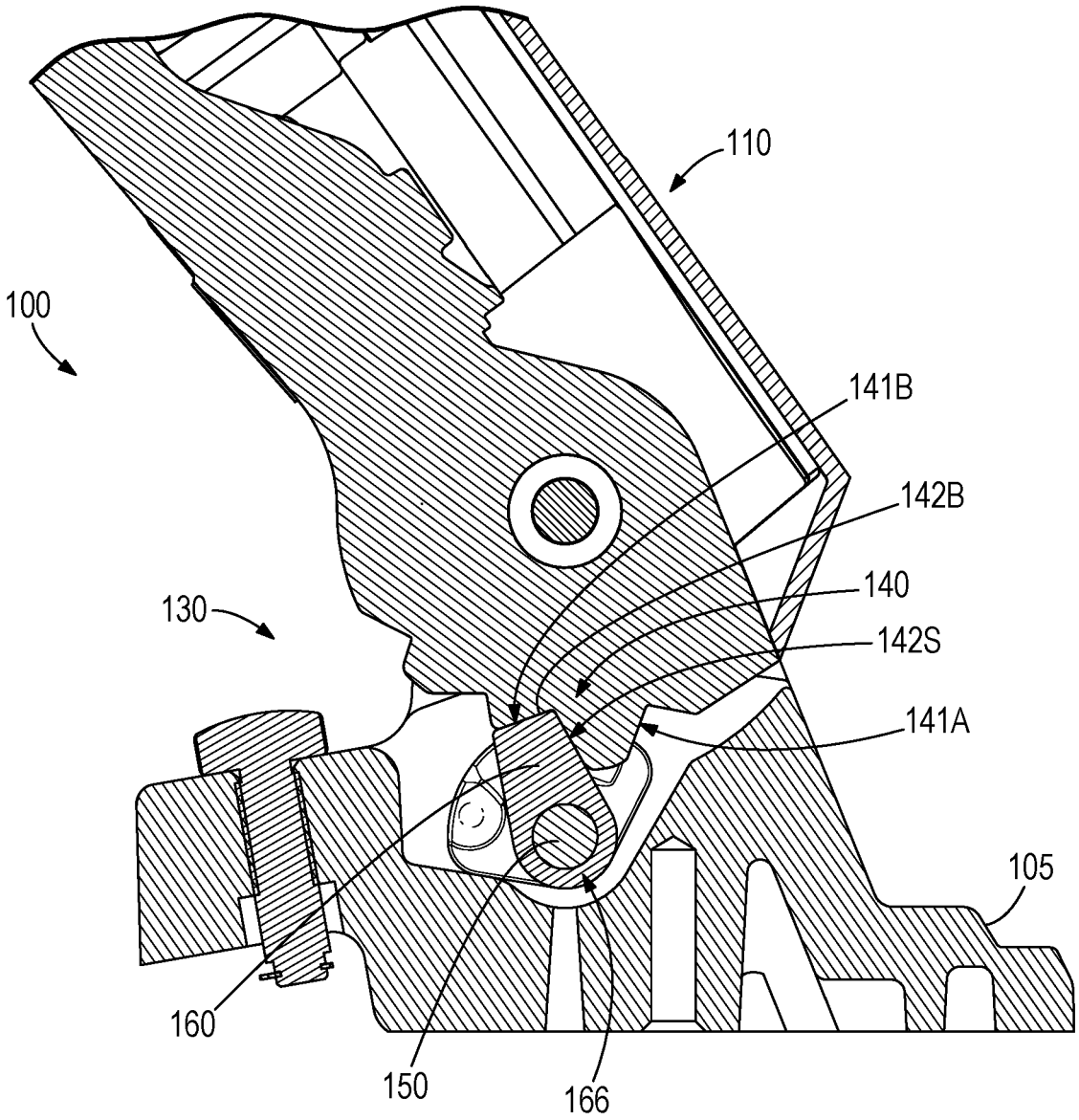
Figure 8:
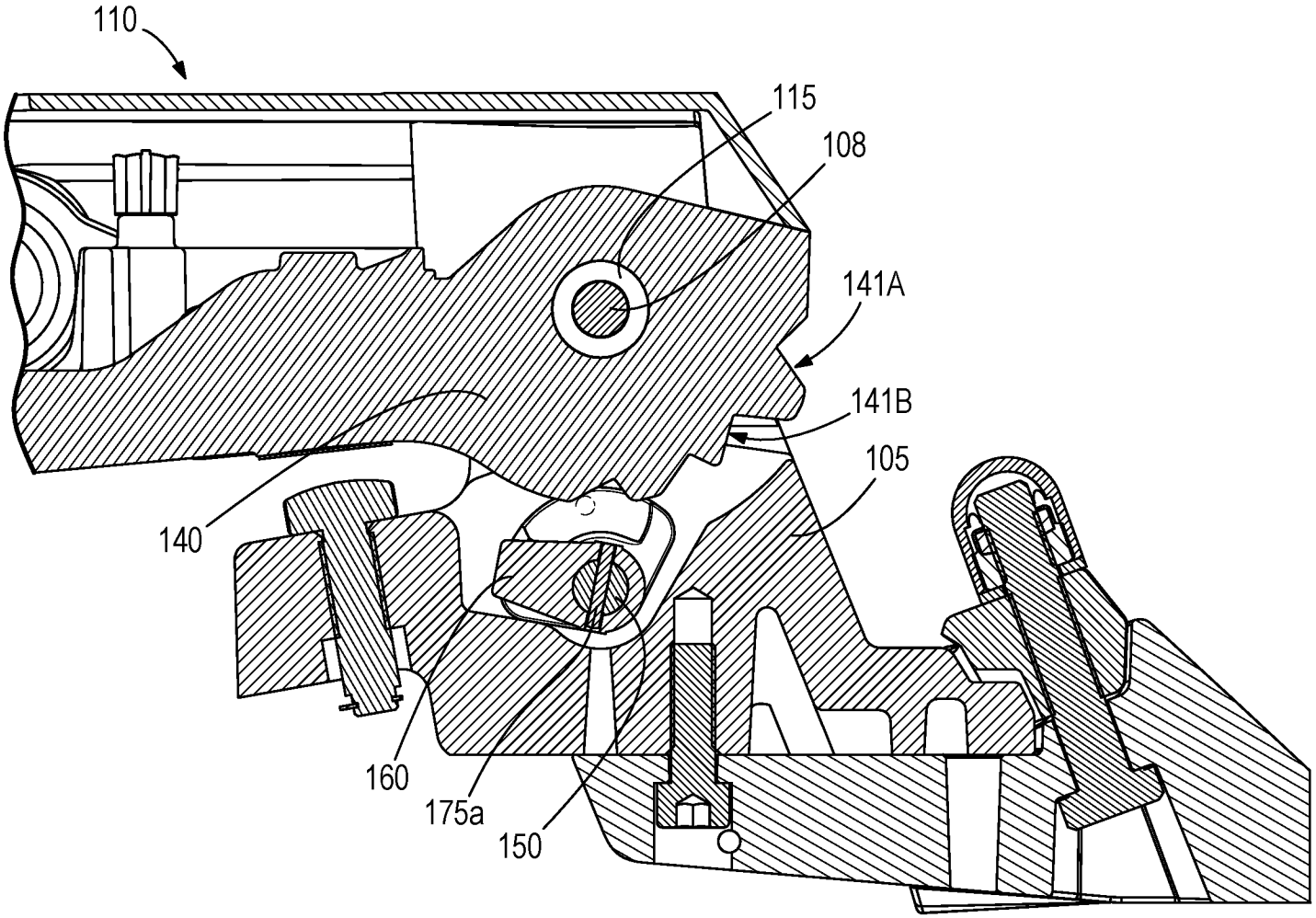
FIG. 8 depicts a side view similar to that shown in FIG. 5 with the tiller arm unlocked.

As shown in FIGS. 5-7, the first lock portion 140 includes an up index 141A and a first intermediate index 141B, as well as a second intermediate index 141C and a third intermediate index 141D. However, any number of indexes may be incorporated into the first lock portion 140, providing any number of desired tilt angles to lock the tiller arm 110. In practice, the tiller arm 110 is rotated upwardly towards the up position 11A (see FIG. 1) until the second lock portion 160 engages with an index within the first lock portion 140 to lock the tiller arm 110 at that desired tilt angle. Once locked in a given index, the tiller arm 110 is prevented from rotating downwardly until the tilt lock system 130 is deactivated (shown in FIG. 8), but may in certain embodiments continue to rotate upwardly. However, certain indexes of certain embodiments are alternatively provided as non-locking positions, such as the down index 141E shown in FIGS. 5-7. When the second lock portion 160 engages the first lock portion 140 in a non-locking position, the tiller arm 110 is not prevented from rotating further downwardly.

FIGS. 5-7 depict each of the indexes (shown here as 141A-141E) within the first lock portion 140 to be defined by one or more surfaces. These surfaces include a bottom surface 142B, a side surface 142S, and/or a ramp surface 142R. As shown, the surfaces of the first lock portion 140 that form these indexes, along with the spring loading of the second lock portion 160 to be discussed below, allow the tiller arm 110 to be freely tilted upwardly toward the up position in a ratcheting manner. Specifically, the second lock portion 160 rides or follows along the surfaces of the first lock portion 140 until automatically engaging with the next index of the first lock portion 140. The presently disclosed tilt lock system 130 does not require manual engagement and disengagement of the second lock portion 160 between positions as the tiller arm 110 is pivoted upwardly. Additional details regarding the mechanism for this automatic engagement are discussed further below.

Returning to FIGS. 4 and 11, the second lock portion 160 engages with a second lock portion retainer 190 to activate or deactivate the tilt lock system 130. The second lock portion 160 is rotatable relative to the second lock portion retainer 190, which is fixed relative to the mounting structure 105. A tilt lock shaft opening 196 (FIG. 11) is provided through the second lock portion retainer 190, which allows the tilt lock shaft 150 to extend therethrough. In this manner, the second lock portion 160 is rotatable relative to the second lock portion retainer 190 by rotation of the tilt lock shaft 150 in the manner previously described.

Figure 11:
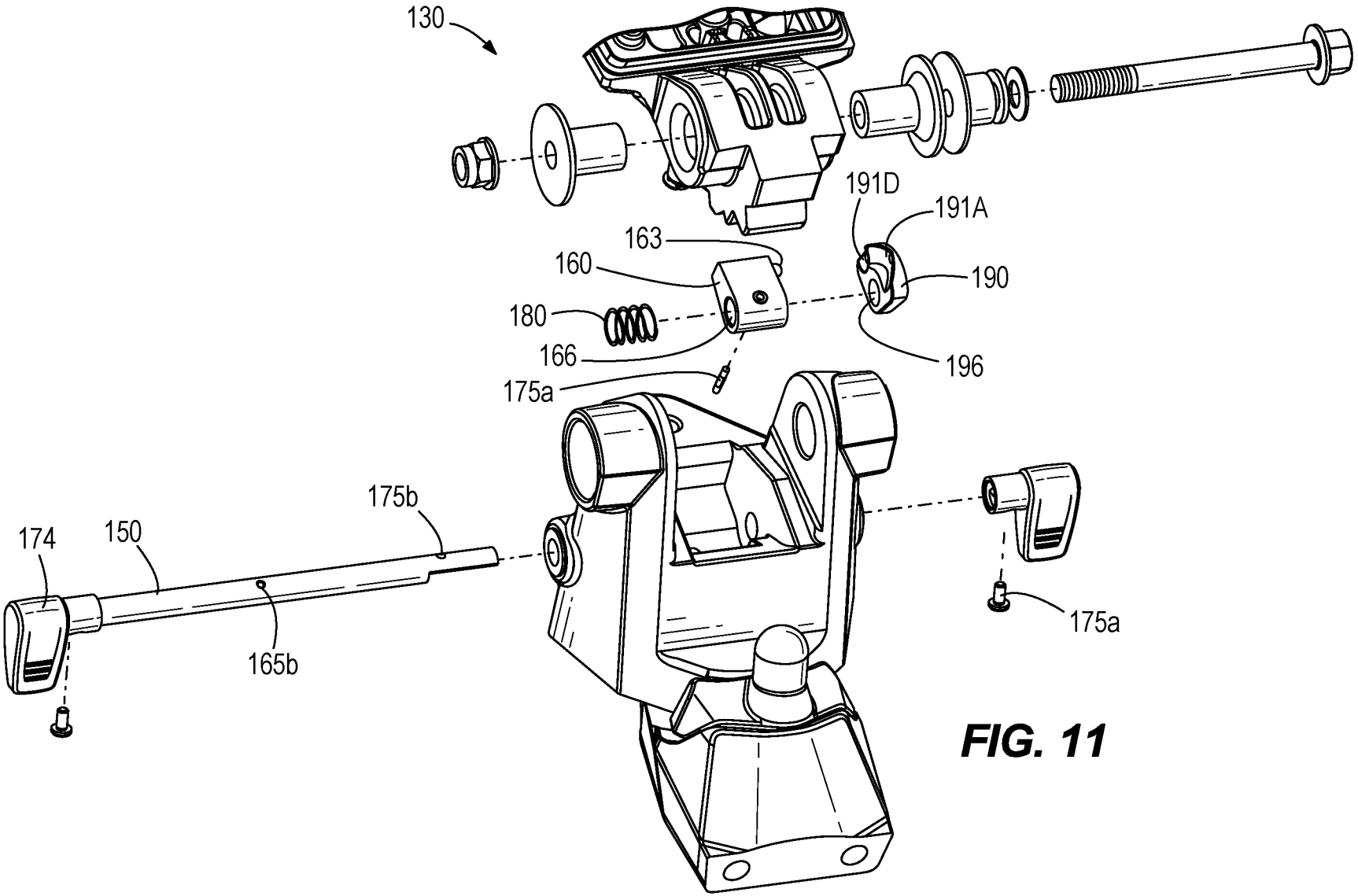

As best seen in FIGS. 4 and 11, the second lock portion retainer 190 has two depressions, an activation index 191A and a deactivation index 191D, each configured to retain the second lock portion 160 therein. When the second lock portion 160 is retained within the deactivation index 191D, the tilt lock system 130 is in the deactivated state. Specifically, the second lock portion retainer 190 prevents the second lock portion 160 from engaging with the first lock portion 140, regardless of the tilt angle of the tiller arm 110. In contrast, when the second lock portion 160 is retained within the activation index 191A, the second lock portion 160 is allowed to engage the first lock portion 140. A ramp feature 192 (FIG. 4) is provided on the second lock portion retainer 190 and separates the activation index 191A and the deactivation index 191D. In this manner, the second lock portion 160 is able to ride or slide along the ramp feature 192 to transition between the activation index 191A and the deactivation index 191D. Therefore, detent features are provided as the activation index 191A and deactivation index 191D to retain the second lock portion 160 in that respective position.

Figure 10:
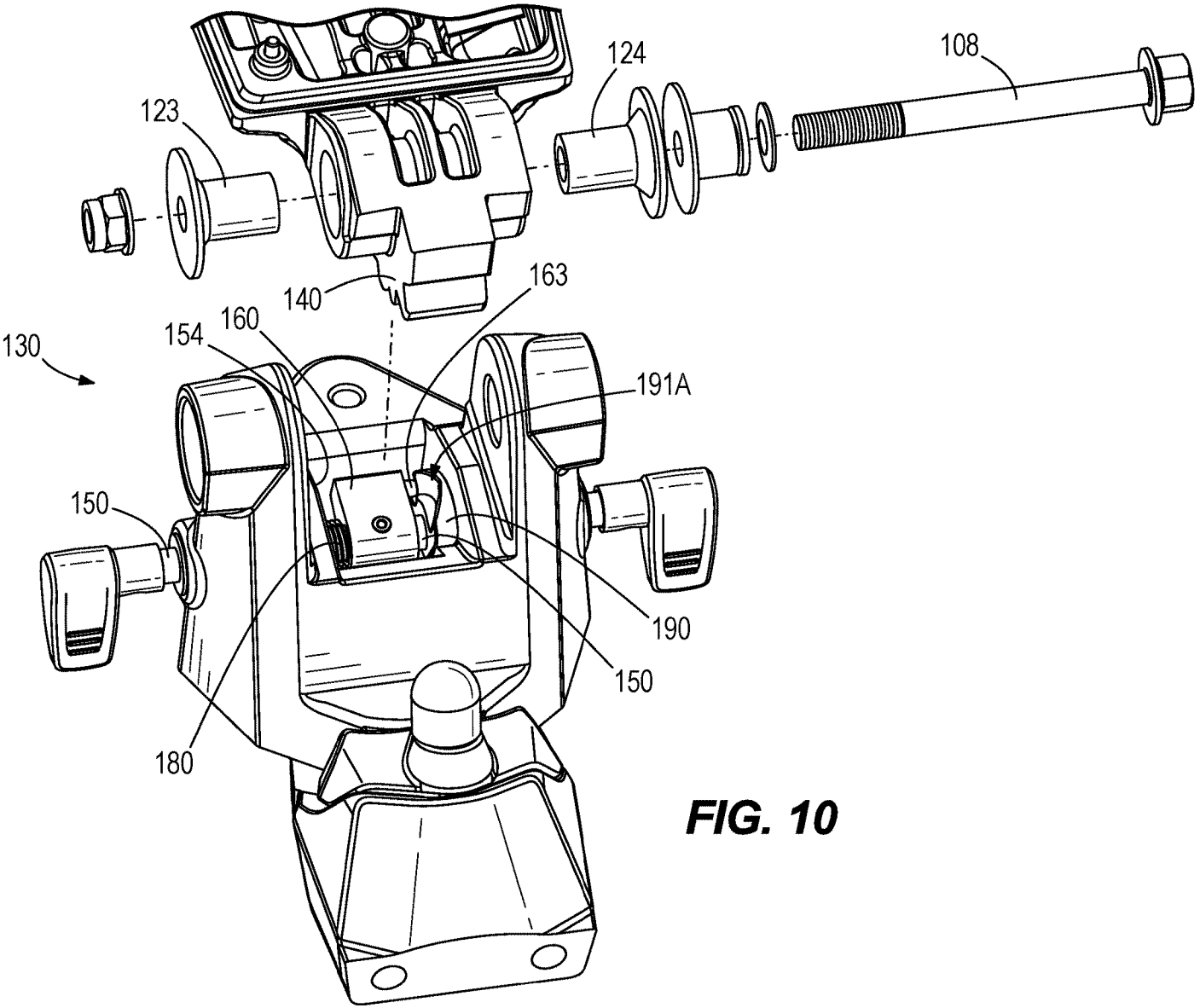
FIGS. 10-11 are further exploded views of the system shown in FIG. 9.

As shown in FIGS. 3-4, a tilt lock bias device, shown here as a spring 180, is coaxially located about the tilt lock shaft 150. Other forms of biasing devices are also known in the art, including springs providing a tensile force, for example. A first end of the spring 180 engages with or abuts against an abutment end 164 of the second lock portion 160. An opposite second end of the spring 180 engages with or abuts against a bias anchoring feature 154. In certain embodiments in which the second lock portion 160 is axially slideable via the teeth 168 within grooves 152 in the tilt lock shaft 150, this bias anchoring feature 154 is a hole, tab, or another fixation device (i.e. a screw) that fixes the spring 180 to the tilt lock shaft 150 (not shown). In other embodiments whereby the second lock portion 160 is fixed (i.e. non-slideable) relative to the tilt lock shaft 150, the tilt lock shaft 150 is axially slideable. In this case, the bias anchoring feature 154 is a hole, tab, or other fixation device (i.e. a screw) that is fixed relative to the mounting structure 105, or a portion of the mounting structure 105 itself (as shown in FIG. 10).

The spring 180 biases the second lock portion 160 into engagement with the second lock portion retainer 190 such that the second lock portion 160 is retained within either activation index 191A or deactivation index 191D. In the embodiment shown, the spring 180 provides a bias force on a bias side 172 of the second lock portion 160, which is opposite of a retainer side 170 of the second lock portion 160 that engages the second lock portion retainer 190. Likewise, the bias anchoring feature 154 (see FIG. 10) is shown as a seat or surface on the mounting structure 105.

FIGS. 5-7 depict the tiller arm 110 locked in three different positions relative to the mounting structure 105. In particular, FIG. 5 depicts the tilt lock system 130 oriented such that an engagement end 162 of the second lock portion 160 engages the first lock portion 140 within a third intermediate index 141D. Similarly, FIG. 6 depicts the second lock portion 160 engaged with a second intermediate index 141C, and FIG. 7 depicts the second lock portion 160 engaged with a first intermediate index 141B. In each case, the second lock portion 160 is retained within the activation index 191A of the second lock portion retainer 190. As previously described, the second lock portion 160 is retained within the second lock portion retainer 190 by virtue of the ramp feature 192 of the second lock portion retainer 190. Additionally, the spring 180 biases the second lock portion 160 into engagement with the second lock portion retainer 190, preventing the second lock portion 160 from climbing the ramp feature 192 to transition to the deactivation index 191D. In certain embodiments (see FIGS. 3-4) the second lock portion 160 has an engagement pin or follower 163 that engages with the second lock portion retainer 190. In such an embodiment, the engagement pin or follower 163 is the portion of the second lock portion 160 that engages the second lock portion retainer 190 and becomes retained in the activation index 191A or deactivation index 191D.

As shown in FIG. 6, each of the indexes within the first lock portion 140 is defined by one or more surfaces. For example, the down index 141E is defined as both a side surface 142S and a ramp surface 142R. In contrast, the third intermediate index 141D is primarily defined by a bottom surface 142B, a side surface 142S, and a ramp surface 142R between the third intermediate index 141D and the second intermediate index 141C. In certain embodiments, the ramp surface 142R is shaped to provide a smooth transition between adjacent indexes when the tiller arm 110 is rotated in the upward direction (such as the transition from down index 141E to third intermediate index 141D in FIG. 5).

As previously described, the tilt lock system 130 is configured such that the second lock portion 160 automatically engages with the first lock portion 140 at certain indexes, but also permits the tiller arm 110 to continue rotating in the upward direction. Specifically, the tilt lock system 130 allows the tiller arm 110 to rotate upwardly without first deactivating the second lock portion 160. The first lock portion 140 and the second lock portion 160 automatically engage with each other at each of the defined indexes along the way. However, it should be noted that in this embodiment the tiller arm 110 cannot be rotated downwardly unless the second lock portion 160 is in the deactivated position or is otherwise disengaged from the first lock portion 140 (see FIG. 8).

Figure 12:
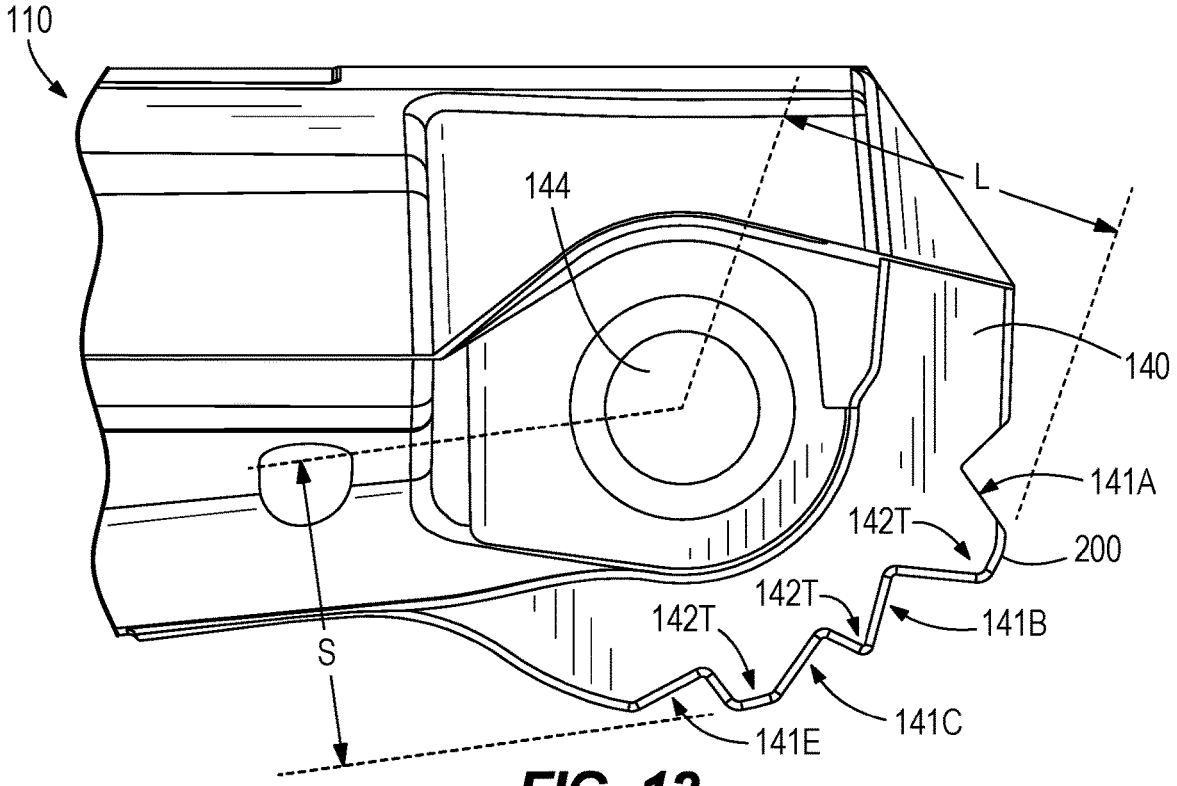
FIGS. 12-13 are close up side and rear perspective views of a portion of a tiller arm similar to that shown in FIG. 2.
Figure 13:
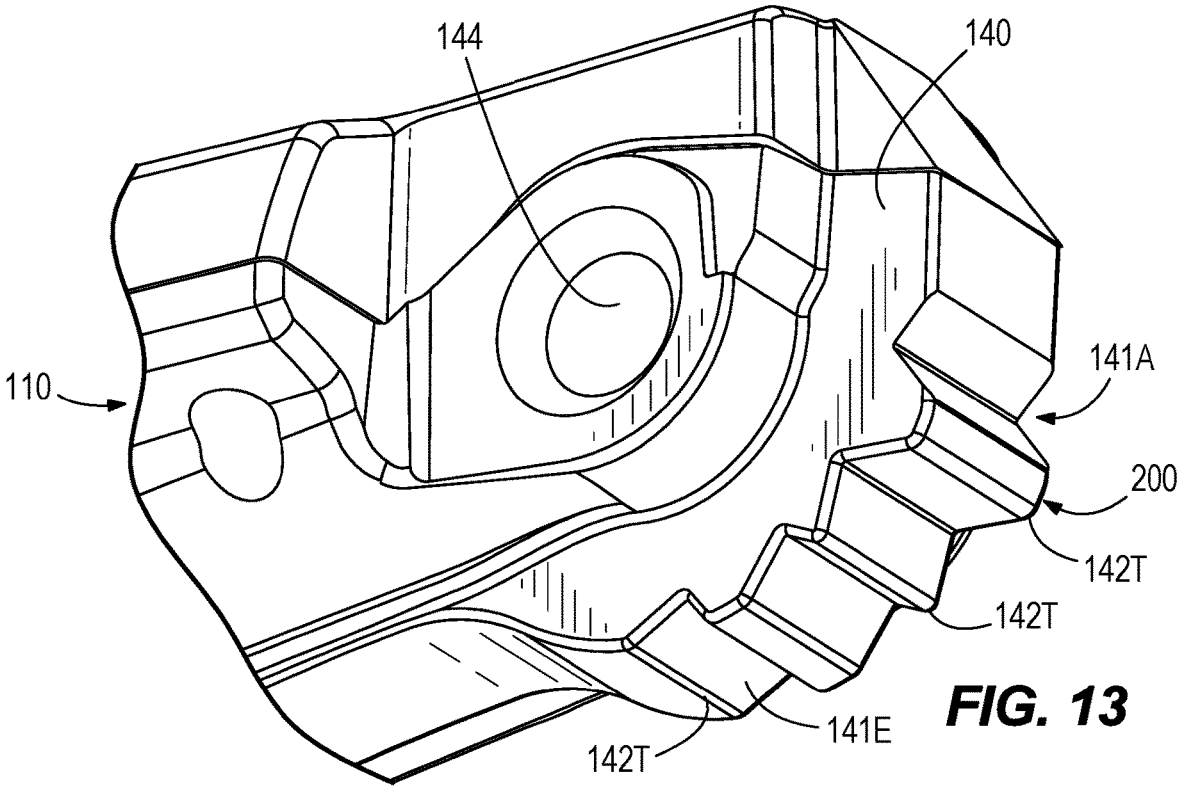

FIGS. 12-13 depict exemplary configurations for automatically disengaging the tilt lock system 130 under certain conditions. Specifically, certain embodiments are configured to disengage the tilt lock system 130 without requiring the operator to disengage the second lock portion 160 from the first lock portion 140 via the tilt lock knobs 174. FIGS. 12-13 depict an embodiment of an unlock feature 200 that automatically transitions the second lock portion 160 from the activation index 191A to the deactivation index 191D of the second lock portion retainer 190. This automatically transitions the second lock portion 160 from the activated position to the deactivated position with respect to the first lock portion 140, deactivating the tilt lock system 130.

FIG. 12 shows a first lock portion 140 having four indexes: an up index 141A, a first intermediate index 141B, a second intermediate index 141C, and a down index 141E. In this case, the first lock portion 140 does not have a third intermediate index (141D), as was shown in FIGS. 5-7. The down index 141E is now provided as a locked position. Additionally, the up index 141A in the embodiment of FIGS. 12-13 is not an automatically locking position, due to having an unlock feature 200 within the first lock portion 140. Additional details regarding the unlock feature 200 are now provided. As best shown in FIG. 12, the first lock portion 140 includes teeth 142T, which generally correspond to structures between adjacent indexes. In contrast to the other teeth 142T shown, one tooth is larger and thus serves as the unlock feature 200. The tooth 142T of the unlock feature 200 extends a radially long distance L away from the tilt axle opening 144 of the tiller arm 110, which is greater than the short distance S of the other teeth 142T.

As the tiller arm 110 is raised, the unlock feature 200 forces the second lock portion 160 from the activation index 191A to the deactivation index 191D of the second lock portion retainer 190. This prevents the second lock portion 160 from engaging within the up index 141A of the first lock portion 140. In this regard, the operator is able to permanently disengage the tilt lock system 130 by simply moving the tiller arm 110 past the up index 141A, which is now a single-handed operation.

Figure 14:
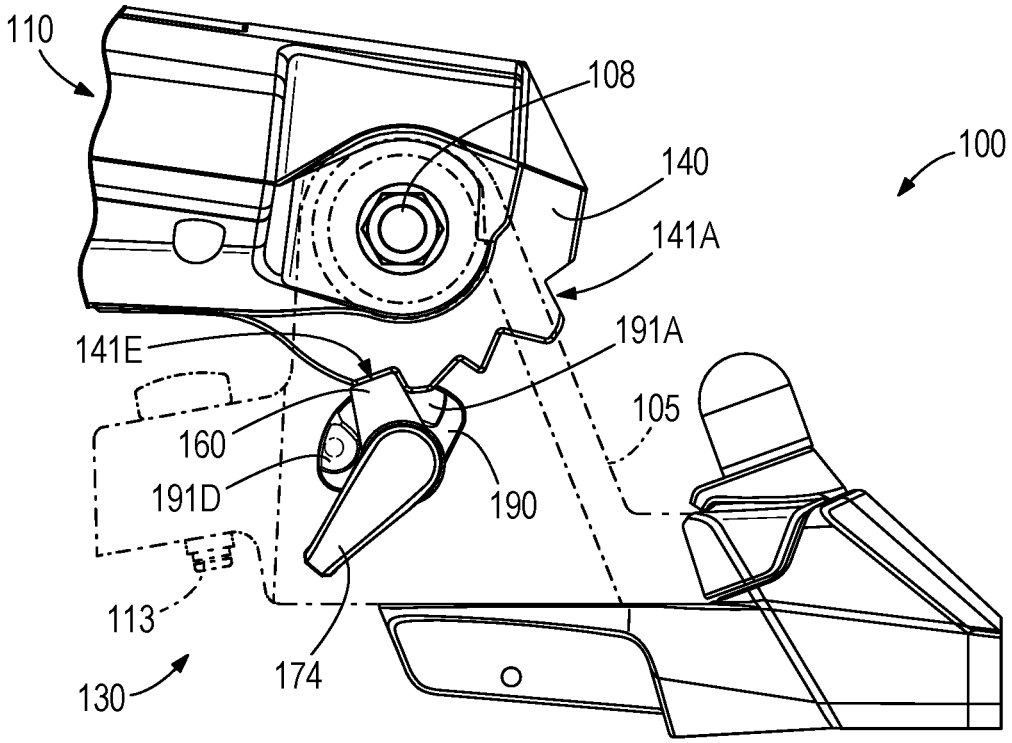
FIGS. 14-17 depict progressive side views of a system similar to that shown in FIGS. 1-2 rotating in the upward direction.
Figure 15:
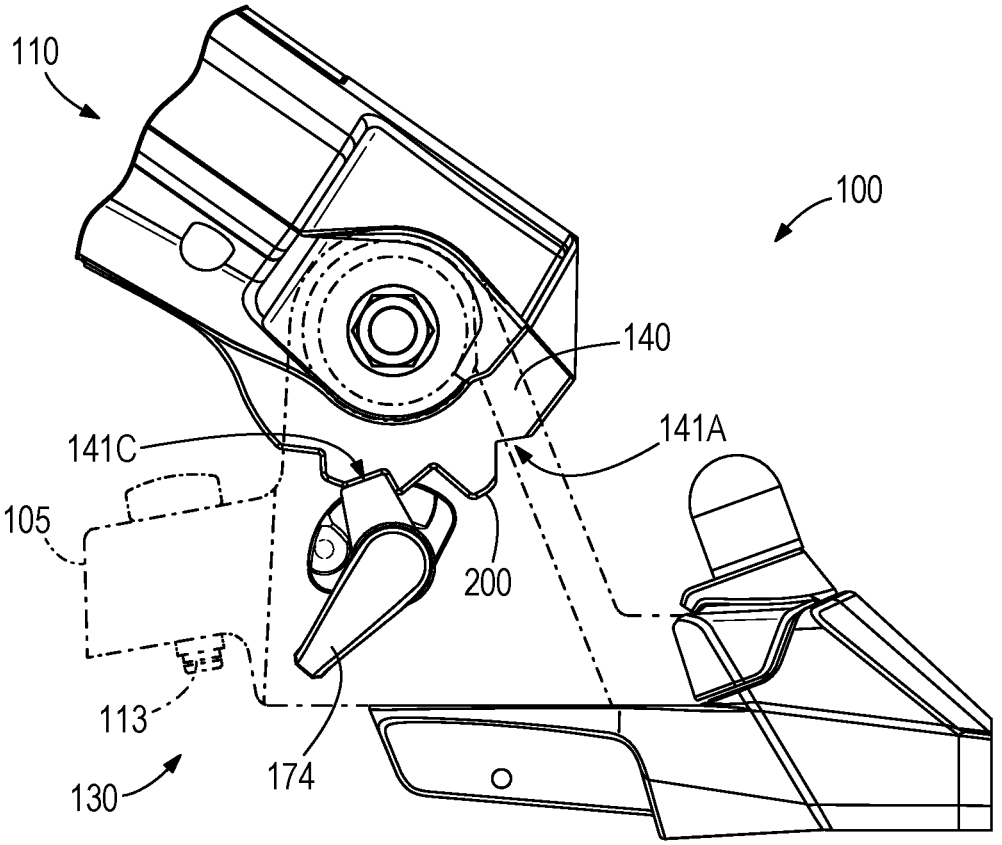
Figure 16:
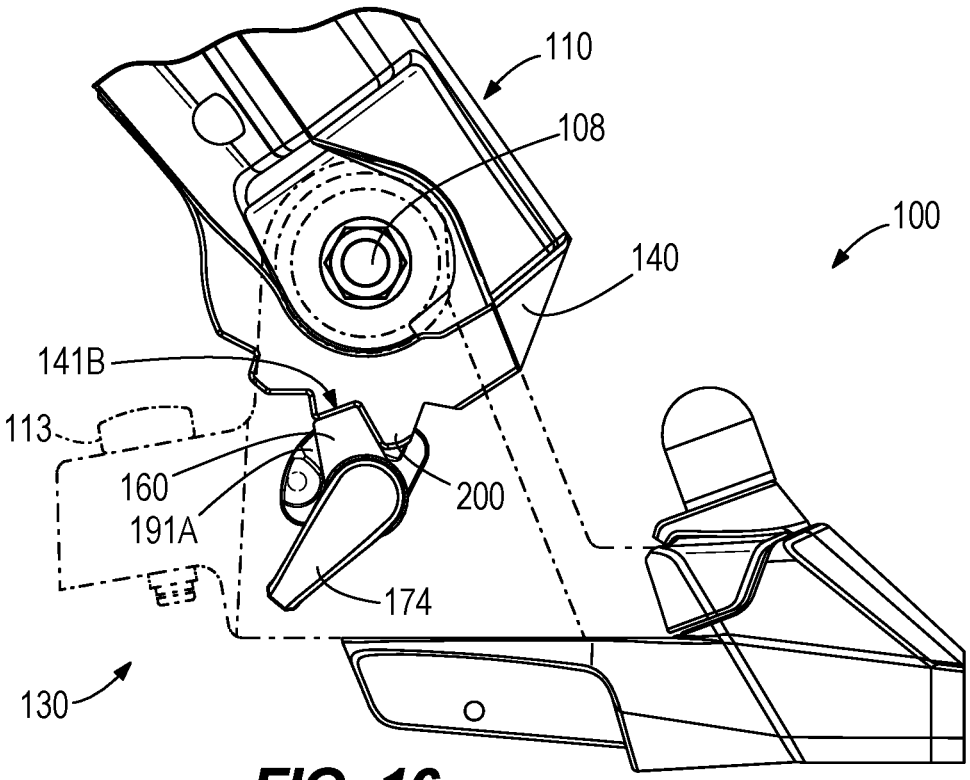

FIGS. 14-17 depict the tiller arm 110 being rotated from the down position 11E (see FIG. 1) upwardly, in sequence. Specifically, FIGS. 14-16 show the second lock portion 160 engaged with the first lock portion 140 in the down index 141E, in the second intermediate index 141C, and in the first intermediate index 141B, respectively. Some rotation of the second lock portion 160 occurs by virtue of each tooth 142T passing or ratcheting over the second lock portion 160. However, the activation index 191A of the second lock portion retainer 190 is large enough (i.e., has a long enough ramp length) to accommodate this rotation without forcing the second lock portion 160 over the ramp feature 192 (see FIG. 4) and out of the activation index 191A.

Figure 17:
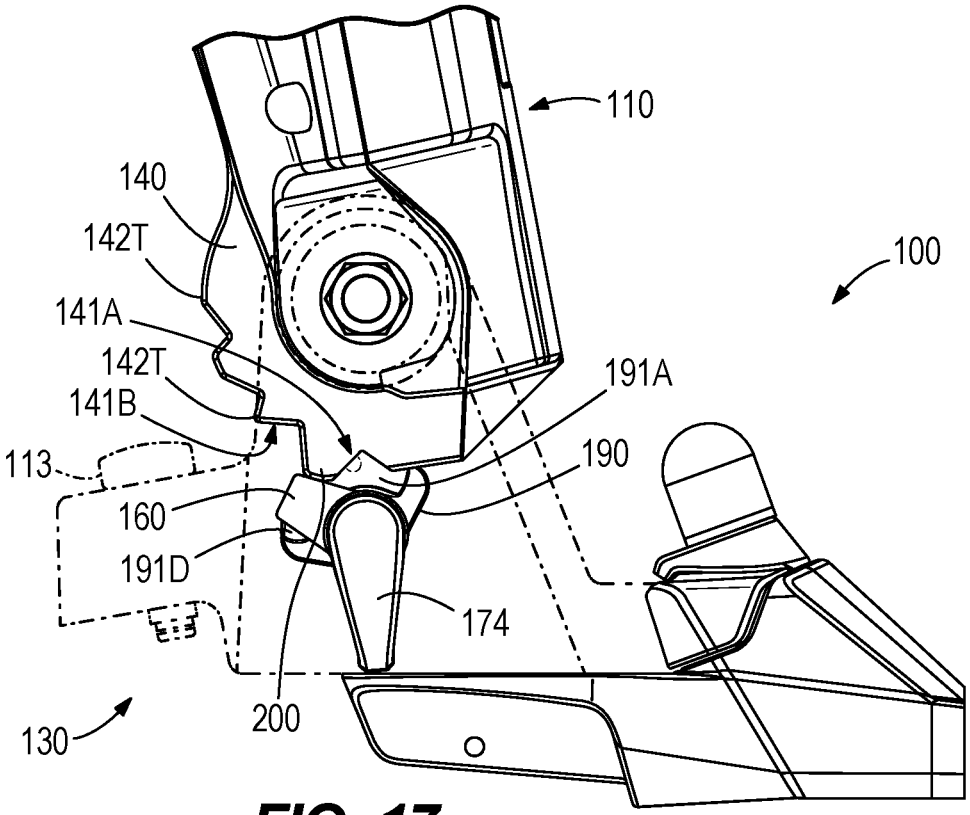

FIG. 17 depicts further upward rotation of the tiller arm 110 relative to the configuration shown in FIG. 16, beyond the first intermediate index 141B. The long distance L of the unlock feature 200 causes the second lock portion 160 to move beyond the activation index 191A of the second lock portion retainer 190 during rotation, in contrast to rotating past the other teeth 142T (see also FIG. 15). Rotating past the unlock feature 200 causes the second lock portion 160 to climb over and surpass the ramp feature 192 within the second lock portion retainer 190 (see FIG. 4) to thereby transition to the deactivation index 191D. At this point, the second lock portion 160 becomes retained within the deactivation index 191D of the second lock portion retainer 190. The second lock portion 160 is consequently retained in a deactivated index 191D and no longer able to engage with the first lock portion 140 until being rotated back to the activation index 191A by the operator via the tilt lock knobs 174.

In this manner, the tilt lock system 130 is automatically disengaged simply by virtue of rotating the tiller arm 110 upwardly to at least the position engaging the unlock feature 200, such as the position shown in FIG. 17. Further upward rotation of the tiller arm 110 past engagement between the unlock feature 200 and the second lock portion 160 does not result in automatic locking of the tiller arm 110. However, manual engagement of the second lock portion 160 with the up index 141A of the first lock portion 140 is possible by turning the tilt lock knob 174. This feature may be desirable, for example, for locking the tiller arm 110 in a trailer position for transportation.

It should be recognized that while the unlock feature 200 is shown to correspond to a tooth 142T positioned before the up index 141A (when rotating upwardly), other positions for the unlock feature 200 are also anticipated by the present disclosure. For example, the unlock feature 200 may be incorporated into a further tooth (not shown) just beyond the up index 141A such that rotation of the tiller arm 110 past the up position causes the tilt lock system 130 to automatically disengage, as previously described. This provides that the tiller arm 110 is lockable in the up position 11A (see FIG. 1), but is still automatically disengaged with further rotation of the tiller arm 110. In this example, the tilt lock system 130 can still be automatically disengaged without requiring manual manipulation of the tilt lock knob 174.

In practice, the present disclosure provides for a tilt lock system that automatically releases the tilt lock if a tiller is raised beyond a certain position, such as close to the full tilt or trailer position. While certain embodiments depict the automatic release (i.e. disengagement) to occur beyond the up position, other embodiments are anticipated in which the tilt lock system 130 is disengaged at a position before the up position is reached, as previously described. In either case, the presently disclosed systems provide easy methods for the operator to disengage the tilt lock without having to reach back and access the tilt lock knobs 174.

Moreover, the present inventors have recognized that the presently disclosed tilt lock system 130 also prevents the tiller arm 110 from locking in the full tilt position following an underwater impact (such as hitting a log), whereby locking would be detrimental to maintaining optimum steering control. In other words, if a log-strike condition causes the tiller arm 110 to rise to the up-most position, the tilt lock system 130 automatically disengages. This would allow the tiller arm 110 to be immediately positioned at a lower tiller arm 110 angle for optimum steering leverage.

Additionally, the presently disclosed systems provide for several positions for locking the tiller arm 110 between the up position and the down position. The present inventors have identified that this is particularly advantageous in that the tiller arm 110 may be positioned in accordance with the trim level of the propulsion device, including as the trim is changed when underway. For example, a first position might be desired when the propulsion device is trimmed in, another when the propulsion device is partially trimmed, and yet another when the propulsion device is fully trimmed out. Moreover, the present disclosure also allows the operator to permanently disengage the tilt lock system 130 manually, simply by shifting the second lock portion 160 to the deactivated position, wherein it is engaged with the second lock portion retainer 190 within the deactivation index 191D.

The present disclosure further relates to additional embodiments for providing tilt locking with tiller arms that in certain embodiments also incorporate the automatic release functionality discussed above. Through additional research and development, the inventors have identified that existing locking mechanisms for tiller arms known in the art may be limited in the particular lock positions that may be offered. For example, certain tiller arms presently known in the art provide for three locking positions (in addition to up and down positions), such as 12 degrees, 30 degrees, and 55 degrees from the down position or horizontal plane. The inventors have identified that the particular materials used to produce the tiller arm may be limiting on these locking positons, such as requiring a spacing of at least 15-20 degrees therebetween, to ensure sufficient material between the teeth to not result in deformation. For example, casting a tiller arm from aluminum requires a coarser teeth configuration than may be desired, due to the limitations of aluminum and specifically its strength.

The inventors have also recognized that the present integration of teeth into a tiller arm often requires the application of a coating to the pawl, such as a plastic like Rilsan. This coating is necessary to prevent the pawl from abrading the paint and exposing bare aluminum over use, creating the potential for corrosion. This coating adds cost and manufacturing time, and further requires an increase in the spacing between teeth to accommodate the additional thickness between the teeth and the pawl. As will become apparent, the systems and methods disclosed herein provide for flexibility in reducing the angular distance between teeth (also increasing an overall number of teeth allowable within a given locking system), as well as mechanisms for avoiding the need for coatings between the pawl and teeth in a tiller locking system.

Figure 18A:
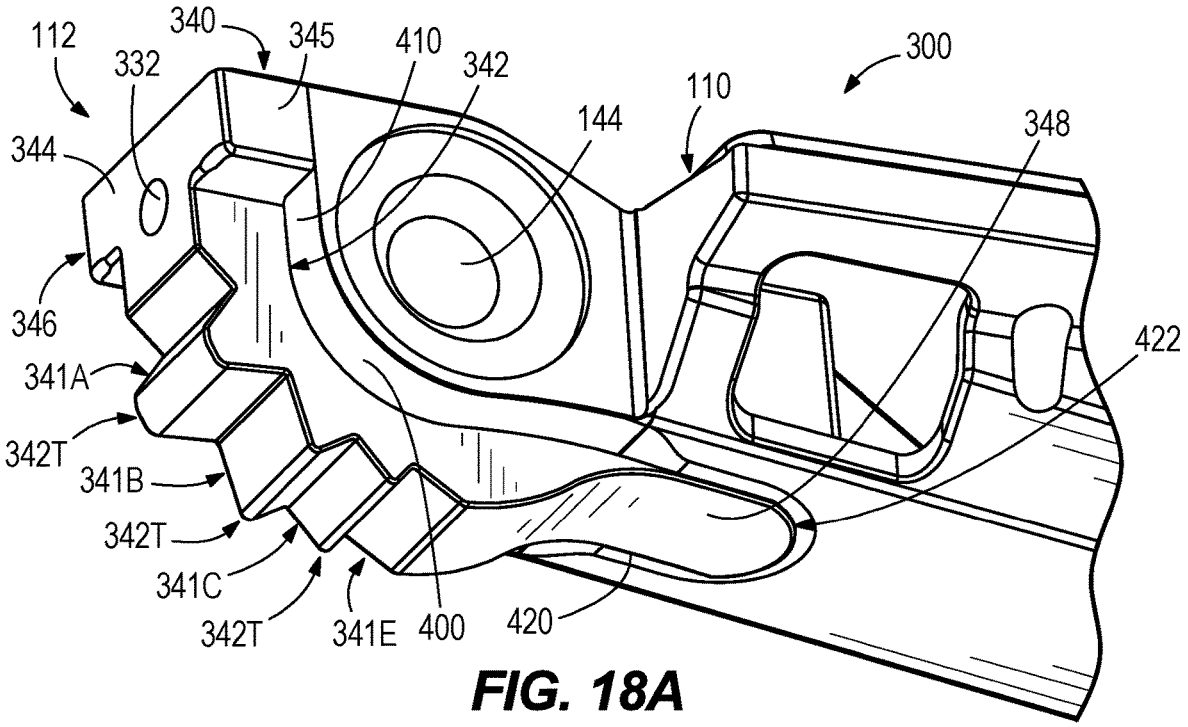
FIGS. 18A-18B are rear perspective views of alternative embodiments of systems for incorporating tilt locking into tillers according to the present disclosure.
Figure 18B:
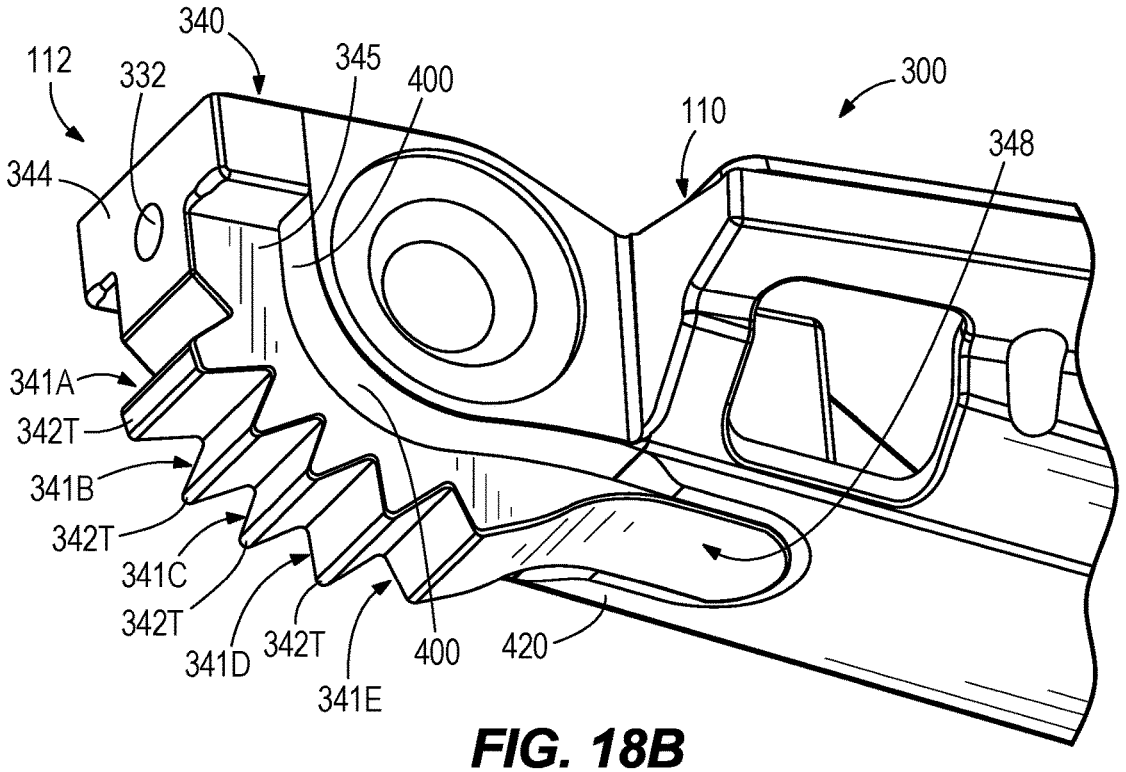

FIGS. 18A-18B depict a first example of a tiller system 300 providing greater flexibility and durability over those presently known in the art. As previously discussed, the tiller system 300 includes a tiller arm 110 that is rotatably coupled to an outboard motor, specifically being rotatable between a down position and an up position with lock positions therebetween. The tiller arm 110 may be comprised of the same material as others presently known in the art, such as aluminum. However, in contrast to the tiller systems discussed above, the present example provides for a toothed member 340 that is coupled to the tiller arm 110, rather than the teeth 142T being integrally formed therewith of a single, cast-in material, for example (see FIG. 5).

In the examples of FIGS. 18A-18B, the toothed member 340 has an outer face 344 defining a plurality of teeth 342T, which are otherwise similar to the teeth 142T discussed above. The toothed member 340 further includes an inside face 342 opposite the outside face 344, which is configured to be coupled to a mounting face 400 at the pivot end 112 of the tiller arm 110. The toothed member 340 is further defined as having a back side 346 and a bottom side 348 and has sides 345 extending between the inside face 342 and the outside face 344. The back side 346 of the toothed member 340 is generally aligned to a back side 410 of the tiller arm 110, and likewise the bottom side 348 of the toothed member 340 with a bottom side 420 of the tiller arm 110. It will be recognized that the inside face 342 of the tooth member 340 is configured to correspond to the mounting face 400 of the tiller arm 110. However, this is not a required limitation of the present disclosure.

In certain embodiments, a back fastener opening 332 is defined through the back side 346 of the toothed member 340 for receiving a fastener 330 to couple the toothed member 340 to the mounting face 400 of the tiller arm 110. The fastener 330 is then received within the tiller arm 110, such as within a back fastener receiver 336 threaded within the back side 410 of the mounting face 400 (see FIG. 19). An additional bottom fastener opening (not shown) may also be provided through the bottom side 348 for receiving a fastener 330 therein in a similar manner.

Figure 19:
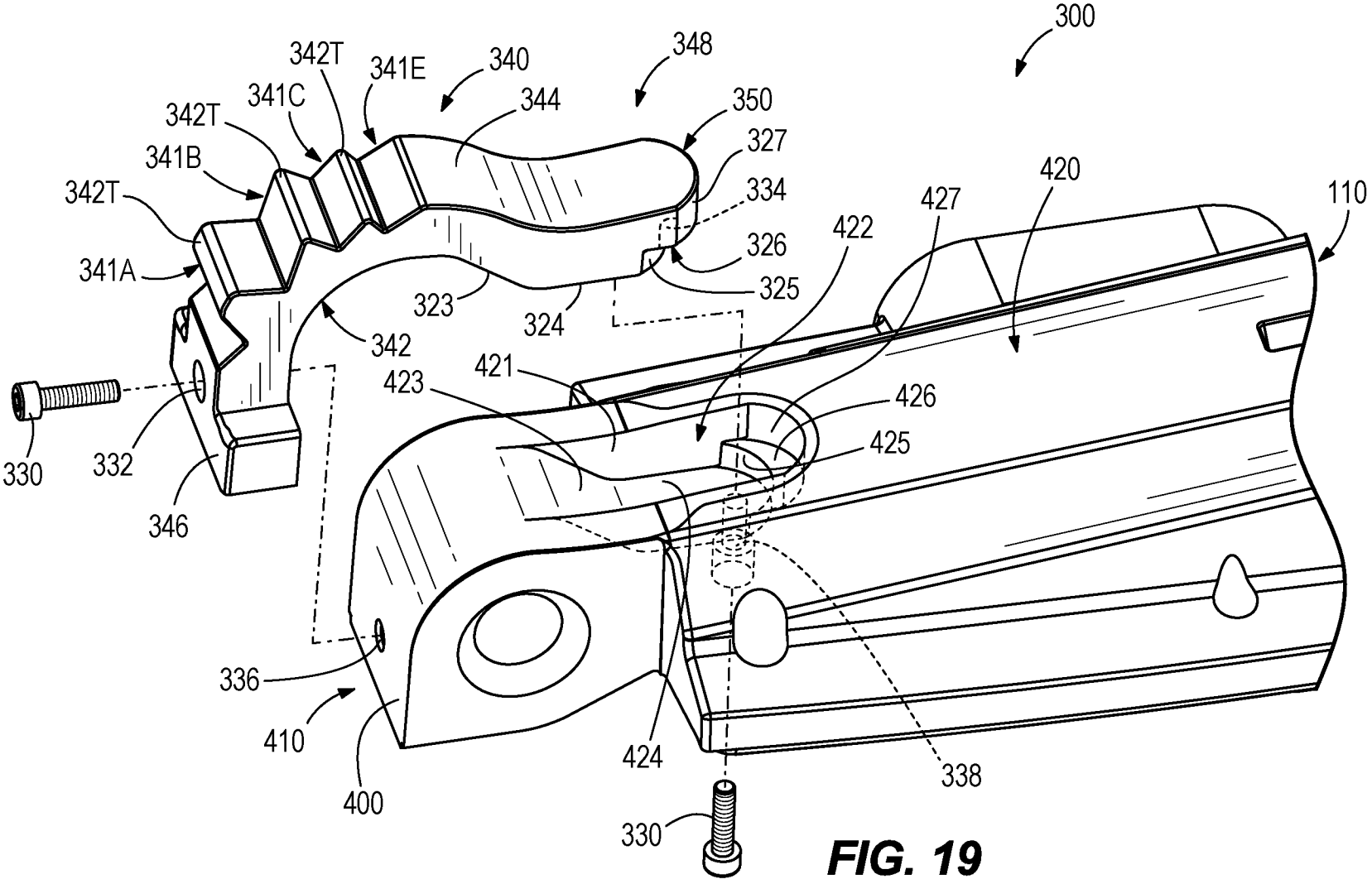
FIG. 19 is an exploded isometric view of the embodiment from FIG. 18A shown from the bottom.

Alternatively, rather than the fastener 330 extending through the tooth member 340 to be receivable within the tiller arm 110, the embodiment of FIG. 19 is configured such that the fastener 330 is instead received through a fastener opening 338 defined in the tiller arm 110, which engaged with a bottom fastener receiver 334 in the toothed member 340. It should be recognized that the various openings and receivers for these fasteners 330 may be alternated between the tiller arm 110 and toothed member 340, and in greater or fewer quantity than that shown.

By providing the toothed member 340 as a distinct component from the tiller arm 110, it will be recognized that these two elements may be comprised of different materials. For example, the tiller arm 110 may be comprised of an aluminum alloy, whereas a higher-strength stainless steel alloy or a composite material such as Zytel or glass-filled nylon may be used for the toothed member 340. By using a higher-strength alloy for the toothed member 340, the present system 300 is not limited to the same restrictions with respect to spacing between the teeth 342T, allowing more teeth 342T overall, or a more fine-tuned distinction between respective locking positions. For example, in the example of FIG. 18A, three teeth 342T are provided on the locking member 340, offering a first intermediate index 341B and second intermediate index 341C as locking positions in addition to the up index 341A and down index 341E. This locking configuration is similar to that of FIG. 12, but allows the toothed member 340 to be made of a different material from the tiller arm 110, increasing durability and avoiding the need for a coating between the teeth 342T and the pawl (second lock portion 160 in FIG. 5).

In contrast, the example of FIG. 18B, enabled by the increased strength of the material used for the toothed member 340, now includes four teeth 342T, which defines a third intermediate index 341D in addition to the positions previously shown in FIG. 18A. It will recognized that by providing additional teeth 342T, the end user of the tiller arm 110 and system 300 overall is provided with additional locking options, including increased in flexibility in use.

FIG. 19 depicts an exploded view of the embodiment previously shown in FIG. 18A. In this example, the back side 346 of the toothed member 340 is coupled flush to the back side 410 of the mounting face 400 for the tiller arm 110, whereas the bottom side 348 of the toothed member 340 is at least partially received within a toothed member receiver 422 defined within the bottom side 420 of the tiller arm 110. In the example shown, the toothed member receiver 442 is defined to have a sloped portion 423 extending downwardly to a base 424. A shelf wall 425 extends outwardly from the base 424 to a shelf floor 426, which extends upwardly via a tab wall 427 to the bottom side 420. It will be recognized that the inside face 342 of the toothed member 340 is corresponding formed to have similar structures, including a sloped portion 323 transitioning to a base 324 that corresponds to the base 424 of the toothed member receiver 422. The toothed member 340 further defines a shelf wall 325 extending from a base 324 to a shelf floor 326, which correspond to the shelf floor 426 and shelf wall 425 of the toothed member receiver 422. A front wall 327, which generally forms a front tab 350 of the toothed member 340, is received in abutment with the tab wall 427 of the tiller arm 110.

In some, the systems 300 of FIGS. 18A-19 provide for coupling of a toothed member 340 to a tiller arm 110, or interchangeability of toothed members 340 as may be convenient for different models or user needs, through simple removal and installation of fasteners 330. In certain embodiments, the fasteners 330 are obscured from the operators view by positon and/or cowlings and coverings.

Figure 20:
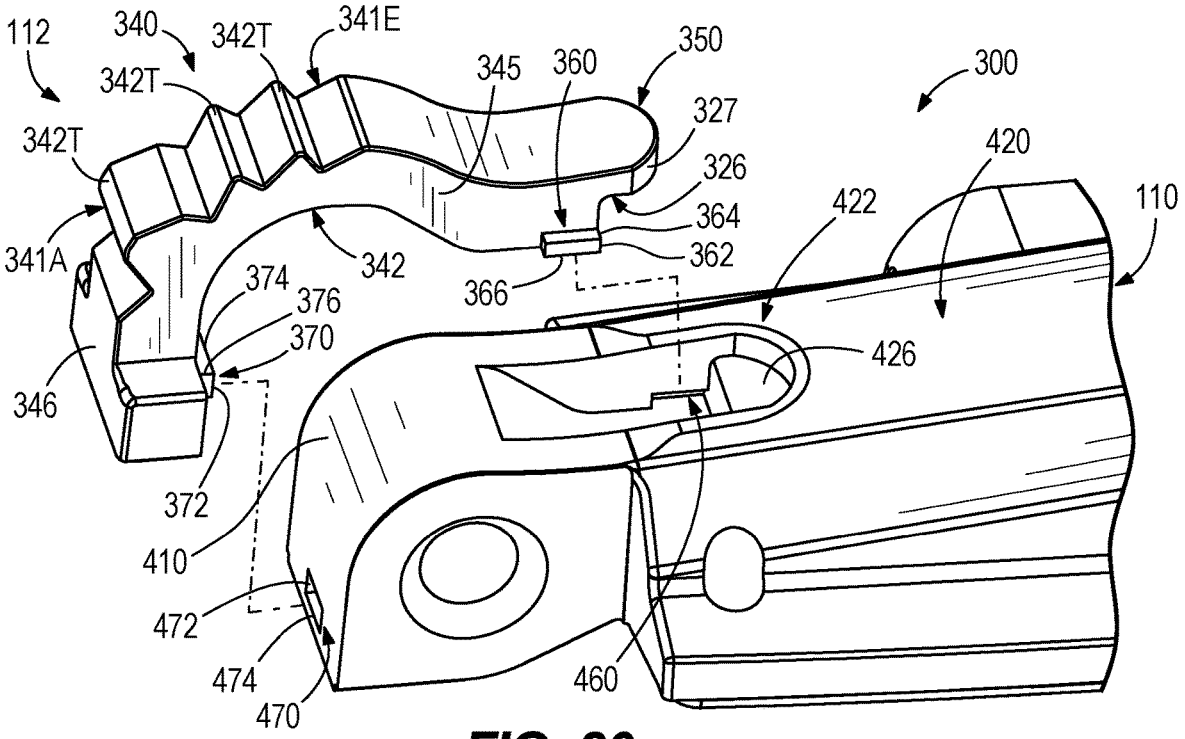
FIGS. 20-21 are exploded isometric views that depicts alternate embodiments for systems similar to that shown in FIG. 19.
Figure 21:
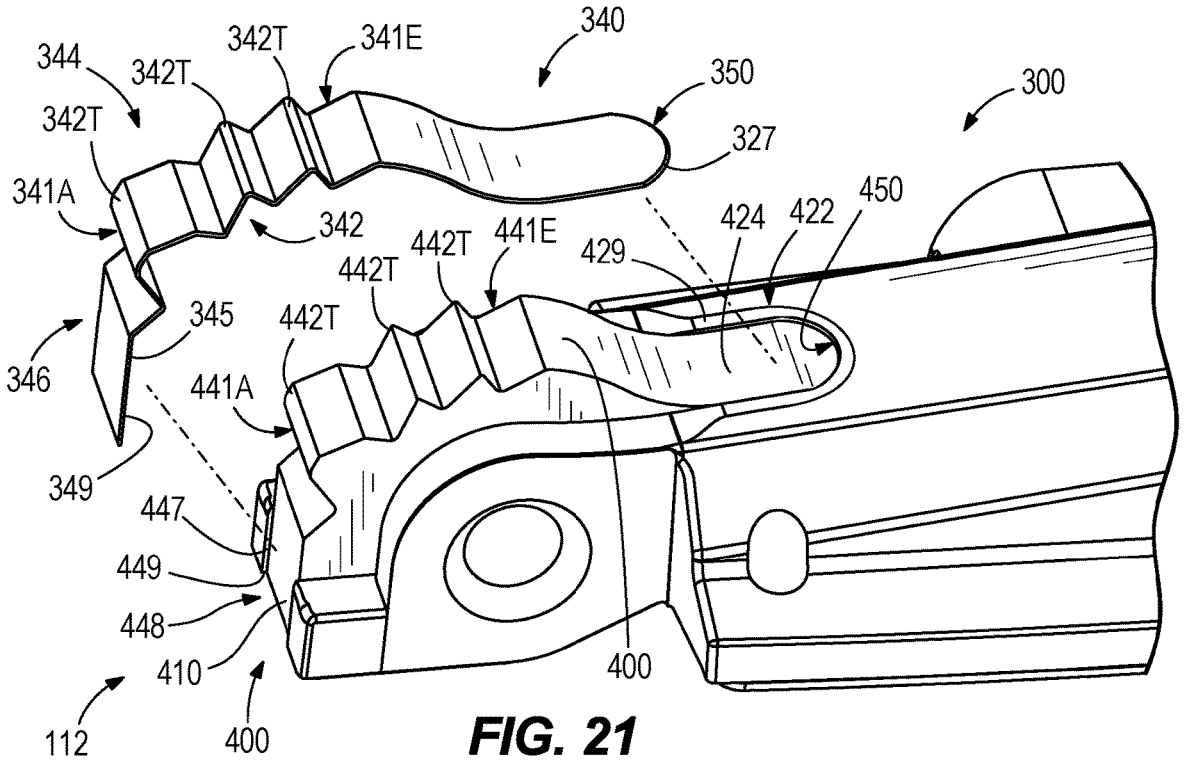

FIGS. 20 and 21 depict two alternative embodiments providing similar functionality and flexibility as discussed above. In the embodiment of FIG. 20, the toothed member 340 is particularly configured to be directly cast into the tiller arm 110 during production thereof. In the example shown, the toothed member 340 further includes two side tabs 360 extending outwardly from the sides 345, each have a height 362, width 364, and depth 366. A side tab receiver 460 is correspondingly defined along with a toothed member receiver 422 during the casting process when the toothed member 340 is positioned therein. The side tab receives 460 thus also have a height 462, width 464, and depth 466.

Similarly, a back tab 370 is defined to project forwardly from the inside face 342 of the toothed member 340, particularly at the back side 346. The back tab 370 is configured to be received within a back tab receiver 470 defined within the back side 410 of the tiller arm 110. A back tab 370 has a height 372, width 374, and depth 376, which when cast with the tiller arm 110 defines a back tab receiver 470 having a corresponding height 472, width 474, and depth (not separately numbered). It will be recognized that the side tab 360 prevents movement of the toothed member 340 relative to the tiller arm 110 in all directions, and the back tab 370 further prevents torquing and twisting about the side tabs 360 from the back side 346.

FIG. 21 depicts as further embodiment for a system 300 according to the present disclosure, this time used in conjunction with a tiller 110 that still defines teeth, in this example base teeth 442T. In contrast to the teeth 142T molded directly into the tiller arm 110 for engagement with a pawl as discussed above (for example in FIG. 13), the base teeth for 442T are not configured to engage directly with the pawl (second lock portion 160, see FIG. 5). Instead, these base teeth 442T provide support for the teeth 342T in the toothed member 340, which in the present example is a sheet having thickness 349, whereby the toothed member 340 ultimately contacts the pawl 160. In the embodiment shown, the toothed member 340 and particularly the front tab 350 thereof is received within a tab recess 450 defined within the bottom side 420 of the tiller arm 110. In this manner, the front tab 350 is prevented from exiting the toothed member receiver 422 via a lip 429 within the bottom side 420, whereby the front tab 350 is retained therein by sliding forwardly towards the handle end 114 of the tiller arm 110 (see FIG. 1).

As also shown in FIG. 21, the back side 346 of the tooth member 480 (having a thickness 349), is receivable within a channel 448 having a depth 449 defined within the back side 410 of the tiller arm 110. In this manner, the toothed member 340 and tiller arm 110 are flush when coupled, specifically with respect to the back sides 410 and 346. The channel 448 also prevents torquing or lateral movement of the toothed member 340 relative to the tiller arm 110, particularly by engagement between the sides 447 of the channel 448 and the sides 345 of the toothed member 340.

In certain embodiments, the toothed member 340 of FIG. 21 is coupled to the tiller arm 110 via adhesives. However, it should be recognized that other mechanisms for coupling the toothed member 340 and tiller arm 110 are also anticipated, including the use of fasteners 330 (See FIG. 19) as previously discussed.

In the above description, certain terms have been used for brevity, clarity, and understanding. No unnecessary limitations are to be inferred therefrom beyond the requirement of the prior art because such terms are used for descriptive purposes and are intended to be broadly construed. The different assemblies described herein may be used alone or in combination with other devices. It is to be expected that various equivalents, alternatives and modifications are possible within the scope of any appended claims.

What is claimed is:

1. A tiller system for steering a marine propulsion device, the tiller system comprising:

a tiller arm rotatably coupled to the marine propulsion device, the tiller arm being rotatable from a down position to an up position through a plurality of lock positions therebetween;

a toothed member removably coupled to one of the tiller arm and the marine propulsion device so as to be replaceable, the toothed member defining a plurality of teeth corresponding to the plurality of lock positions for the tiller arm; and a pawl coupled to another of the tiller arm and the marine propulsion device, wherein the pawl engages with the plurality of teeth to prevent the tiller arm from rotating downwardly through the plurality of lock positions.

2. The tiller system according to claim 1, wherein the toothed member is coupled to the tiller arm and the pawl is coupled to the marine propulsion device.

3. The tiller system according to claim 1, wherein the toothed member is coupled to the tiller arm via fasteners.

4. The tiller system according to claim 1, wherein the pawl has an activated state and a deactivated state, wherein the pawl prevents the tiller arm from rotating downwardly through each of the plurality of lock positions only when the pawl is in the activated state.

5. The tiller system according to claim 1, wherein the plurality of lock positions include at least three distinct positions.

6. The tiller system according to claim 1, wherein at least one of the plurality of lock positions locks the tiller arm between 10 and 60 degrees relative to the down position.

7. The tiller system according to claim 1, wherein the tiller arm is comprised of a first material having a first strength, wherein the toothed member is comprised of a second material having a second strength that is greater than the first strength.

8. The tiller system according to claim 7, wherein the tiller arm comprises of aluminum.

9. The tiller system according to claim 7, wherein the plurality of lock positions include at least four positions other than the down position and the up position.

10. The tiller system according to claim 7, wherein the pawl is also comprised of the second material.

11. The tiller system according to claim 7, wherein the pawl is comprised of a pawl material, and wherein the pawl material directly contacts the second material of the toothed member.

12. A tiller system according to claim 1, wherein the plurality of lock positions for the tiller arm between the down position and the up position includes at least five lock positions, wherein the plurality of teeth of the toothed member includes at least five teeth corresponding to the at least five lock positions for the tiller arm.

13. The tiller system according to claim 12, wherein the toothed member is removably coupled to the tiller arm with threaded fasteners, wherein the tiller arm is comprised of a first material having a first strength, and wherein the toothed member is comprised of a second material having a second strength that is greater than the first strength.

14. The tiller system according to claim 13, wherein the second strength is sufficiently strong to permit the plurality of teeth to be less than 15 degrees apart.

15. A tiller system for steering a marine propulsion device, the tiller system comprising:

a tiller arm rotatably coupled to the marine propulsion device, the tiller arm being rotatable from a down position to an up position through a plurality of lock positions therebetween;

a toothed member coupled to one of the tiller arm and the marine propulsion device, the toothed member defining a plurality of teeth corresponding to the plurality of lock positions for the tiller arm; and a pawl coupled to another of the tiller arm and the marine propulsion device, wherein the pawl engages with the plurality of teeth to prevent the tiller arm from rotating downwardly through the plurality of lock positions;

wherein the tiller arm is comprised of a first material having a first strength, wherein the toothed member is comprised of a second material having a second strength that is greater than the first strength; and wherein the second strength is sufficiently strong to permit the plurality of teeth to be less than 15 degrees apart.

16. A tiller system for steering a marine propulsion device, the tiller system comprising:

a tiller arm rotatably coupled to the marine propulsion device, the tiller arm being rotatable from a down position to an up position through a plurality of lock positions therebetween;

a toothed member coupled to one of the tiller arm and the marine propulsion device, the toothed member defining a plurality of teeth corresponding to the plurality of lock positions for the tiller arm; and a pawl coupled to another of the tiller arm and the marine propulsion device, wherein the pawl engages with the plurality of teeth to prevent the tiller arm from rotating downwardly through the plurality of lock positions;

wherein the tiller arm defines a recess for partially receiving a portion of the toothed member.

17. The tiller system according to claim 16, wherein the tiller arm extends along a length, and wherein the recess includes a first locking feature that prevents the portion of the toothed member from exiting the recess in a direction perpendicular to the length of the tiller arm.

18. A tiller system for steering a marine propulsion device, the tiller system comprising:

a tiller arm rotatably coupled to the marine propulsion device, the tiller arm being rotatable from a down position to an up position through a plurality of lock positions therebetween;

a toothed member coupled to one of the tiller arm and the marine propulsion device, the toothed member defining a plurality of teeth corresponding to the plurality of lock positions for the tiller arm; and a pawl coupled to another of the tiller arm and the marine propulsion device, wherein the pawl engages with the plurality of teeth to prevent the tiller arm from rotating downwardly through the plurality of lock positions;

wherein the plurality of teeth defined by the toothed member overlay a plurality of base teeth defined in the one of the tiller arm and the marine propulsion device to which the toothed member is coupled.

19. The tiller system according to claim 18, wherein the toothed member is a stamped piece of metal.

* * * * *